US009630821B2

(12) United States Patent
Chase

(10) Patent No.: US 9,630,821 B2
(45) Date of Patent: Apr. 25, 2017

(54) CLAMPING ASSEMBLY FOR LOAD-CARRYING VEHICLE

(75) Inventor: Daniel F. Chase, Longview, WA (US)

(73) Assignee: Loron, Inc., Kelso, WA (US)

( * ) Notice: Subject to any disclaimer, the term of this patent is extended or adjusted under 35 U.S.C. 154(b) by 850 days.

(21) Appl. No.: 13/604,553

(22) Filed: Sep. 5, 2012

(65) Prior Publication Data

US 2013/0058746 A1 Mar. 7, 2013

Related U.S. Application Data

(60) Provisional application No. 61/531,560, filed on Sep. 6, 2011.

(51) Int. Cl.
*B66F 9/18* (2006.01)

(52) U.S. Cl.
CPC ..... *B66F 9/183* (2013.01); *B66F 9/185* (2013.01)

(58) Field of Classification Search
CPC ..... B66F 9/18; B66F 9/183; B66F 9/185
USPC ..... 414/621
See application file for complete search history.

(56) References Cited

U.S. PATENT DOCUMENTS 2,782,065 A * 2/1957 Lord ..... 294/87.1
3,104,023 A * 9/1963 Smith et al. ..... 414/621
3,971,585 A * 7/1976 LaBudde ..... 294/207
3,990,594 A 11/1976 Olson et al.
4,201,510 A 5/1980 Muntjanoff
4,315,428 A * 2/1982 Stuivenwold ..... G01H 3/12 310/336
4,431,365 A 2/1984 Sturtz, Jr.
4,725,186 A * 2/1988 Jerue ..... 414/627
4,997,389 A * 3/1991 Doumani ..... H01R 12/79 439/493
5,336,039 A * 8/1994 House ..... 414/621
5,364,146 A * 11/1994 Brandorff et al. ..... 294/86.4
5,984,617 A * 11/1999 Seaberg ..... B66F 9/184 294/206
6,027,302 A 2/2000 Nilsson
6,045,324 A * 4/2000 Redman ..... B65G 57/302 414/788.9

(Continued)

OTHER PUBLICATIONS

Cascade Corporation, "AFC—Carton Clamp," 4 pages (2000).

(Continued)

*Primary Examiner* — Michael McCullough
*Assistant Examiner* — Ashley Romano
(74) *Attorney, Agent, or Firm* — Klarquist Sparkman, LLP

(57) ABSTRACT

A clamping assembly for a load-carrying vehicle capable of exerting an adjustable clamping force, comprises first and second clamp arms, and first and second clamp arm sensing elements. The first and second clamp arms are movable towards and away from each other to contact and exert a clamping force on a load sufficient for lifting the load and transporting the load. The first clamp arm sensing elements are positioned at spaced apart locations on the first clamp arm. The second clamp arm sensing elements are positioned at spaced apart locations on the second clamp arm. The first clamp arm sensing elements and the second clamp arm sensing elements are configured sense and feed back forces exerted by the first and second clamp arms, respectively, in engaging the load such that the clamp arms can be moved relative to each other to adjust the clamping force applied to the load.

20 Claims, 19 Drawing Sheets

(56) References Cited

U.S. PATENT DOCUMENTS

| | | | | |
|---|---|---|---|---|
| 6,089,285 | A * | 7/2000 | DeStefano | B66F 9/06 141/1 |
| 6,200,698 | B1 * | 3/2001 | Carlstrom, Jr. | H01M 8/247 429/465 |
| 6,390,751 | B2 | 5/2002 | Jordan et al. | |
| 6,431,816 | B1 | 8/2002 | Jordan et al. | |
| 6,439,826 | B1 | 8/2002 | Jordan et al. | |
| 6,454,511 | B1 * | 9/2002 | Jordan et al. | 414/621 |
| 7,412,919 | B2 | 8/2008 | Chase | |
| 8,078,315 | B2 * | 12/2011 | McKernan et al. | 700/228 |
| 8,091,467 | B2 * | 1/2012 | Petronek | 91/517 |
| 2006/0104781 | A1 * | 5/2006 | Merin | B25J 13/083 414/621 |
| 2009/0101447 | A1 * | 4/2009 | Durham | B66F 9/0755 187/238 |
| 2009/0281655 | A1 * | 11/2009 | McKernan et al. | 700/225 |

OTHER PUBLICATIONS

Cascade Corporation, "D-Series Carton Clamps," 4 pages (2010).
Cascade Corporation, "Electronic Force Control™," 2 pages (2008).
Forkliftaction.com, "Bolzoni Auramo Intelligent Carton Clamp ETX-G3S establishes a new way to handle white goods," Newsletter #229, 2 pages (Oct. 3, 2005).
Loron, Inc. "Carton Clamp," 9 pages (Jul. 2004).
Vandehey, Cascade Corporation, "Electronic Force Control™," 6 pages (Aug. 2008).

* cited by examiner

LOAD FULLY ENGAGED
MAXIMUM CLAMP FORCE

TIP LOAD APPROXIMATELY
1/2 FULLY ENGAGED
CLAMP FORCE

SHORT CARTONS REDUCE
CLAMP FORCE PROPORTIONAL
TO HEIGHT

TOP PAD NOT ENGAGED
APPROXIMATELY
3/4 CLAMP FORCE

DETAIL A

CLAMPING ASSEMBLY FOR LOAD-CARRYING VEHICLE

CROSS REFERENCE TO RELATED APPLICATION

This application claims the benefit of U.S. Provisional Patent Application No. 61/531,560, filed Sep. 6, 2011, which is hereby incorporated by reference.

FIELD

This application relates to load-carrying vehicles, and in particular to a clamping assembly configured for clamp handling of sensitive loads.

BACKGROUND

Clamping assemblies for load-carrying vehicles, such as fork trucks, are known. One type of clamping assembly is designed for use in lifting and moving relatively light loads that are large in size and require delicate handling, such as cartons containing appliances.

Manufacturers continually seek to reduce the overall cost and weight of packaging, which has resulted in cartons that are less rugged and require greater care in handling. For example, appliances are susceptible to damage if their cartons are clamped at an improper location or with excessive force. Damage can also result if the carton is dropped due to insufficient clamping force. Repeated handling of the carton can result in a weakened carton that makes the appliance more susceptible to damage.

Prior approaches have attempted to make use of computers, proportional valves, pressure transducers, related devices and carton specific clamping forces. Such systems are typically very complex and expensive, however, and thus have not proven to be reliable in actual use. There is still a need for repeatedly applying an appropriate clamping force to a variety of different loads in a straightforward way.

SUMMARY

Described below are various implementations of a clamping assembly that addresses shortcomings in the prior art.

In one implementation, a clamping assembly for a load-carrying vehicle capable of exerting an adjustable clamping force on a load comprises first and second clamp arms, and first and second clamp arm sensing elements. The first and second clamp arms are movable towards and away from each other to contact and exert a clamping force on a load sufficient for lifting the load and transporting the load. The first clamp arm sensing elements are positioned at spaced apart locations on the first clamp arm. The second clamp arm sensing elements are positioned at spaced apart locations on the second clamp arm. The first clamp arm sensing elements and the second clamp arm sensing elements are configured to sense and feed back forces exerted by the first and second clamp arms, respectively, in engaging the load such that the clamp arms can be moved relative to each other to exert an appropriate clamping force applied to the load.

The first and second clamp arms can comprise first and second clamp pads, respectively, and each of the first and second clamping pads can comprise a generally planar clamping surface positionable in a generally upright position.

The first clamp arm sensing elements and the second clamp arm sensing elements can comprise bladders filled with fluid. Changes in pressures within the bladders generated by contact between the clamp arms and the load can be used to control the clamping force.

The first clamp arm and the second clamp arm can be configured to be positioned approximately vertically, and the first clamp arm sensing elements and the second clamp arm sensing elements can each include at least a base sensing element and an intermediate sensing element. When the first and second clamp arms are oriented vertically, the base sensing elements are positioned nearest to respective lower edges of the first and second clamp arms, and the intermediate sensing elements are spaced above the base sensing elements. The clamping assembly can further comprise upper sensing elements spaced vertically above the intermediate sensing elements.

The clamping assembly can comprise at least one hydraulic actuator configured to move the first and second clamp arms towards and away from each other and to engage and exert the clamping force on a load. The clamping assembly can comprise a valve connected to the hydraulic actuator and to the first and second clamp arm sensing elements. The valve can be configured to shut off flow to the hydraulic actuator when the forces detected by the first and second sensing elements exceed a predetermined threshold, thereby preventing the clamping force from increasing.

The first and second clamp arms can comprise first and second clamping pads, respectively. The first and second clamping pads can be configured to be positioned generally upright and to comprise a clamping surface having a clamping surface height and a clamping surface depth. The sensing elements can be configured to detect a load that is engaged by less than the clamping surface depth of the first and second clamping surfaces. The sensing elements can be configured to detect a load that is engaged by less than the clamping surface height of the first and second clamping surfaces.

The clamping arms can be configured to exert about 50% of a maximum clamping force if the sensing elements indicate that only distal ends of the first and second clamping pads are engaged with the load.

The clamping assembly can include a diverter valve circuit operable to decrease the adjusted clamping force when a load width is less than a predetermined width. The diverter valve circuit can include a diverter valve triggered by actuator lever mounted to a moving part of the assembly that contacts a stationary part positioned at the predetermined width, thereby causing the diverter valve to divert flow away from the first and second clamp arms and decrease the adjusted clamping force. The load-carrying vehicle can be a lift truck, and the clamping assembly can be coupled to a front end of the lift truck.

As stated, the first clamp arm sensing elements and the second clamp arm sensing elements can comprise fluid filled bladders. Each of the first and second clamp arms can comprise a base member and a clamping pad member coupled to the base member with the respective fluid filled bladders sandwiched therebetween such that forces exerted on the clamping pads are transferred to the respective bladders thereby changing the respective fluid pressures therein. The fluid filled bladders on the first clamp arm can be connected in series to each other, and the fluid filled bladders on the second clamp arm can be connected in series to each other and to the fluid filled bladders on the first clamp arm, thereby allowing fluid pressures within the bladders to be equalized. Each of the first and second clamp arms can have three separate clamping zones.

The clamping assembly can comprise nesting guide bars and slide arms, the slide arms being movable relative to the guide bars to guide the first and second clamp arms during movement towards and away from each other.

The first and second clamp arms can comprise a major contact pad comprising a majority of the clamp arm area and a minor contact pad comprising a minority of the clamp arm area. The major contact pad can be approximately 48 inches in height. The minor contact pad can be approximately 7 inches in height. The first and second clamp anus can define a clamping depth of about 34 inches.

According to a method, controllably clamping a load with a load-carrying vehicle comprises moving first and second opposing clamp arms having respective first and second clamp arm areas into contact with opposite sides of a load, detecting forces exerted on the clamp arms at multiple different locations within each of the first and second clamp arm areas, and automatically controlling the clamp arms to stop moving towards the load if the detected forces exerted on the clamp arms exceed a predetermined threshold.

The method can comprise detecting forces exerted on the clamp arms by detecting pressure changes in fluid filled bladders at the multiple different locations. The method can also comprise automatically controlling the clamp arms to stop moving by feeding back the detected pressure changes and controlling a valve to close if the detected pressure changes exceed a predetermined threshold.

These and other implementations are described in detail in connection with the following drawings.

DETAILED DESCRIPTION

Figure 1:
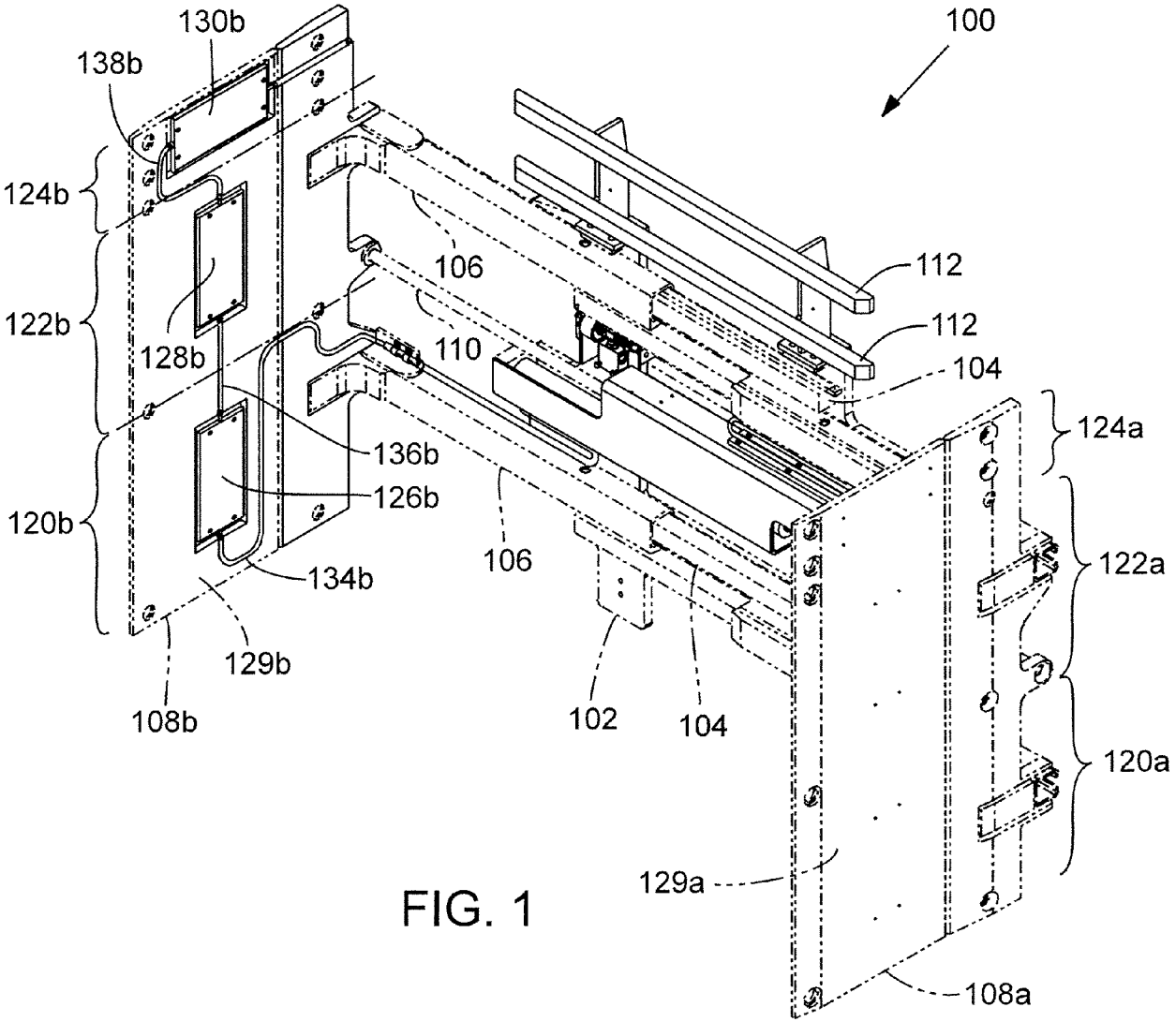
FIG. 1 is a perspective view showing a front side of a clamping assembly.
Figure 2:
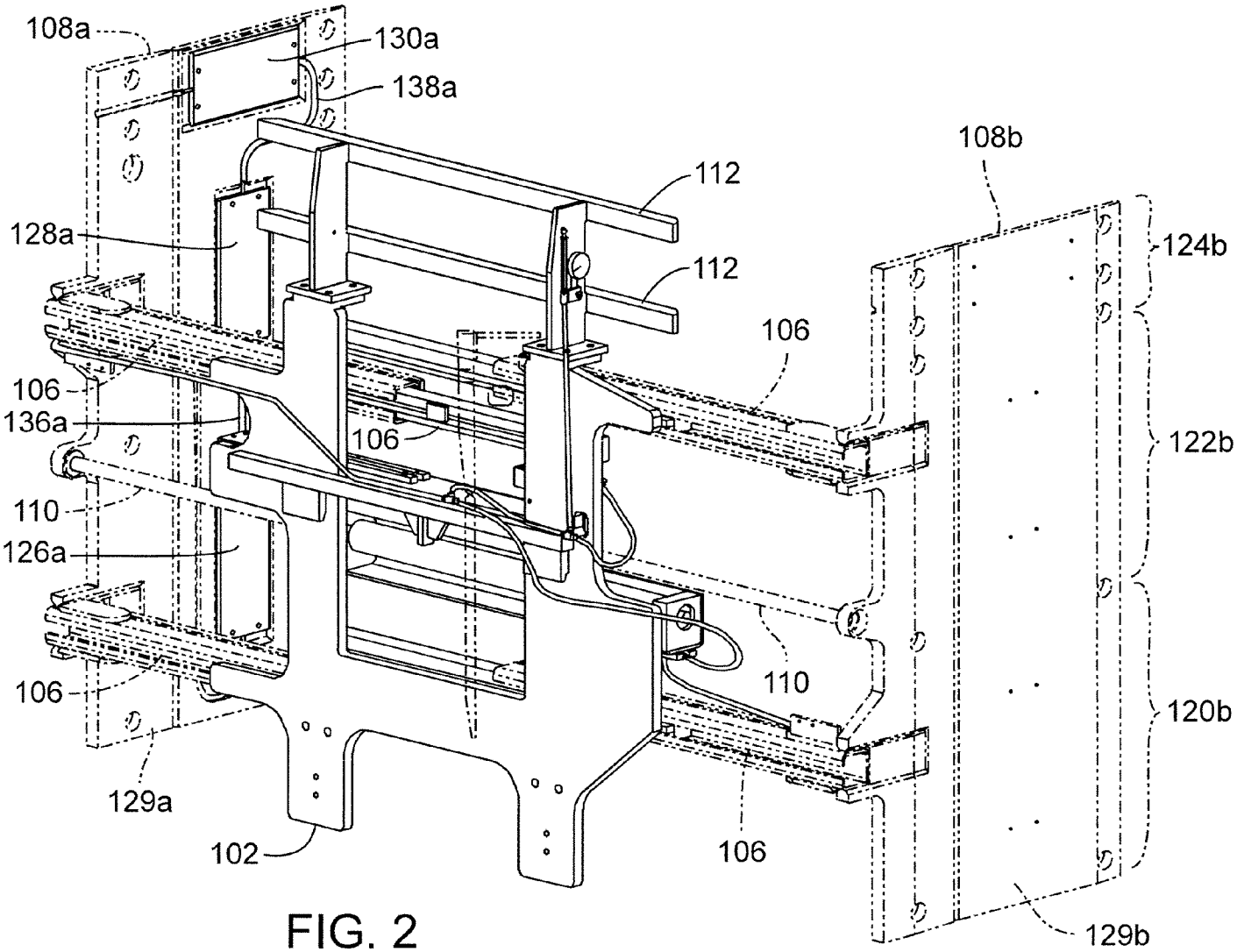
FIG. 2 is a perspective view showing a rear side of the clamping assembly of FIG. 1.

FIGS. 1 and 2 show front side and rear side perspective views, respectively, of a representative clamping assembly 100. As best shown in FIG. 2, the clamping assembly 100 includes a mounting plate 102 by which the clamping assembly can be removably coupled to a load-carrying vehicle, i.e., a lift truck or other type of vehicle. The clamping assembly 100 has a first clamp arm 108A and an opposing second clamp arm 108B that are controllably movable relative to each other, e.g., to engage sides of a load and, with appropriate applied force, to lift and move the load. In the illustrated implementations, the clamp arms 108A, 108B are shown in a generally upright orientation, and thus the first clamp arm 108A is also referred to as the left clamp arm, and the second clamp arm 108B is referred to as the right clamp arm. Commonly owned U.S. Pat. No. 7,412,919, which is incorporated herein by reference, describes additional aspects of clamping assemblies.

The clamp arms 108A, 108B are moved relative to each other using hydraulic force applied through one or more hydraulic cylinders, such as the pair of opposed hydraulic cylinders 110 as shown in FIGS. 1 and 2. The hydraulic cylinders 110 allow for controllably moving the clamp arms 108A, 108B, as well as applying force to a load once the clamp arms 108A, 108B have contacted and engaged the load. In the illustrated implementation, each of the clamp arms 108A, 108B has a pair of slide arms 106 that are slidably supported on stationary guide bars 104 extending horizontally from the mounting plate 102. Thus, there are a total of four slide anus 106 and four horizontal guide bars 104. The slide arms 106 and the guide bars 104 support the clamp arms 108A, 108B in any position over their range of travel and provide for smoothly guided movement between positions. Additional supports, such as the support rails 112, can be configured as shown to provide support for the load and prevent the load from moving rearward.

Figure 3:
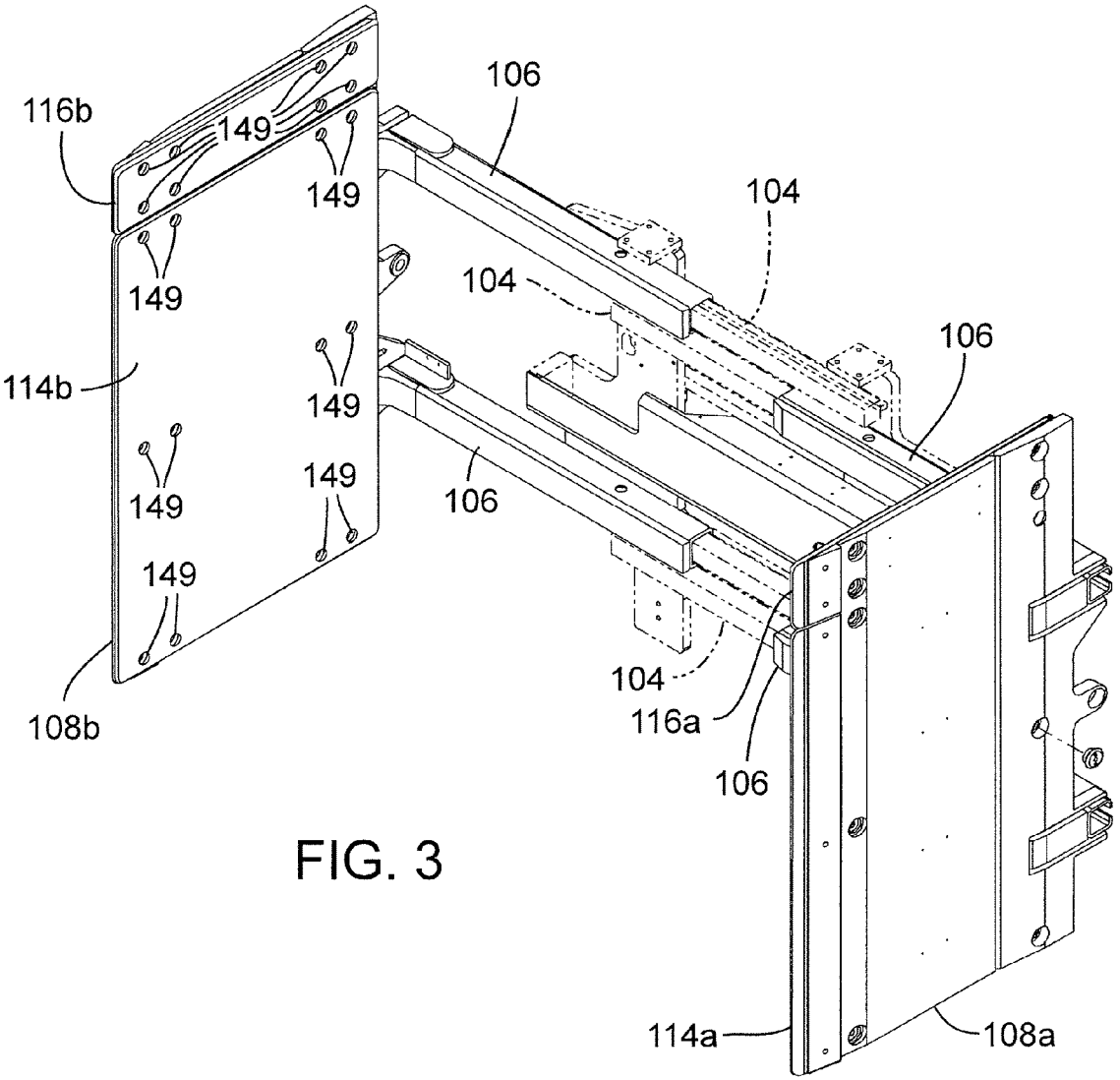
FIG. 3 is a perspective view showing a portion of the clamping assembly together with the clamping pads.

FIG. 3 is an additional front perspective view of the clamping assembly 100 that shows the clamp arm 108B as configured for use with a first clamping pad 114B and a separate second clamping pad 116B positioned adjacent the first clamping pad 114B. Although the inner surface of the clamp arm 108A is not visible in FIG. 3, it is similarly configured with a first clamping pad 114A and a second clamping pad 116A. The clamping pads are typically made of a resilient material supported by a relatively rigid substrate, such as a rubber coating applied over an aluminum plate.

Referring again to FIGS. 1 and 2, the clamp arms 108A, 108B preferably have multiple clamping zones. In the illustrated implementation, each of the clamp arms 108A, 108B has three clamping zones. Assuming a vertical orientation as shown in the drawings, these clamping zones are lower clamping zone 120A, intermediate clamping zone 122A and upper clamping zone 124A (FIG. 1) for the clamp arm 108A, and lower clamping zone 120B, intermediate clamping zone 122B and upper clamping zone 124B (FIG. 2) for the clamp arm 108B.

Each of the clamping zones may have one or more sensing elements or sensors configured to indicate a force or a pressure applied within that clamping zone or within a portion of that clamping zone. As is described below in greater detail, these sensing elements are configured to "send a signal" upon detecting an applied force, which can take the form of a pressure sense signal communicated to the hydraulic system, and controlling the hydraulic system based on the force (pressure) indicated by that signal. In addition to the mechanical sensing elements shown in the illustrated embodiments, other possible types of sensing elements include piezoelectric sensors and other electronic pressure sensors. For example, referring to FIGS. 1 and 2, the clamp arm 108A has three mechanical sensing elements in the form of interconnected fluid-filled sensing bladders 126A, 128A and 130A, with each bladder being arranged in a respective one of the clamping zones 120A, 122A and 124A. Similarly, the clamp arm 108B has three sensing bladders 126B, 128B and 130B that are arranged with one sensing bladder in each of the three clamping zones 120B, 122B and 124B, respectively. As shown in FIG. 1, the bladder 126B is connected by a fluid line segment 134B to controllably interface with the hydraulic system. Line segments 136B and 138B interconnect the bladders 126B and 128B, and 1-8B and 130B, respectively, in series. As a result of the series connections between the bladders on each of the clamp arms, all of the bladders tend to equalize in pressure with each other.

As best shown in FIG. 1, the sensing elements 126A, 126B and 128A, 128B have a generally rectangular shape and are oriented with the longer sides extending vertically. The sensing element 130B is also rectangular and of approximately the same size, but is oriented with its longer sides extending horizontally.

Figure 7:
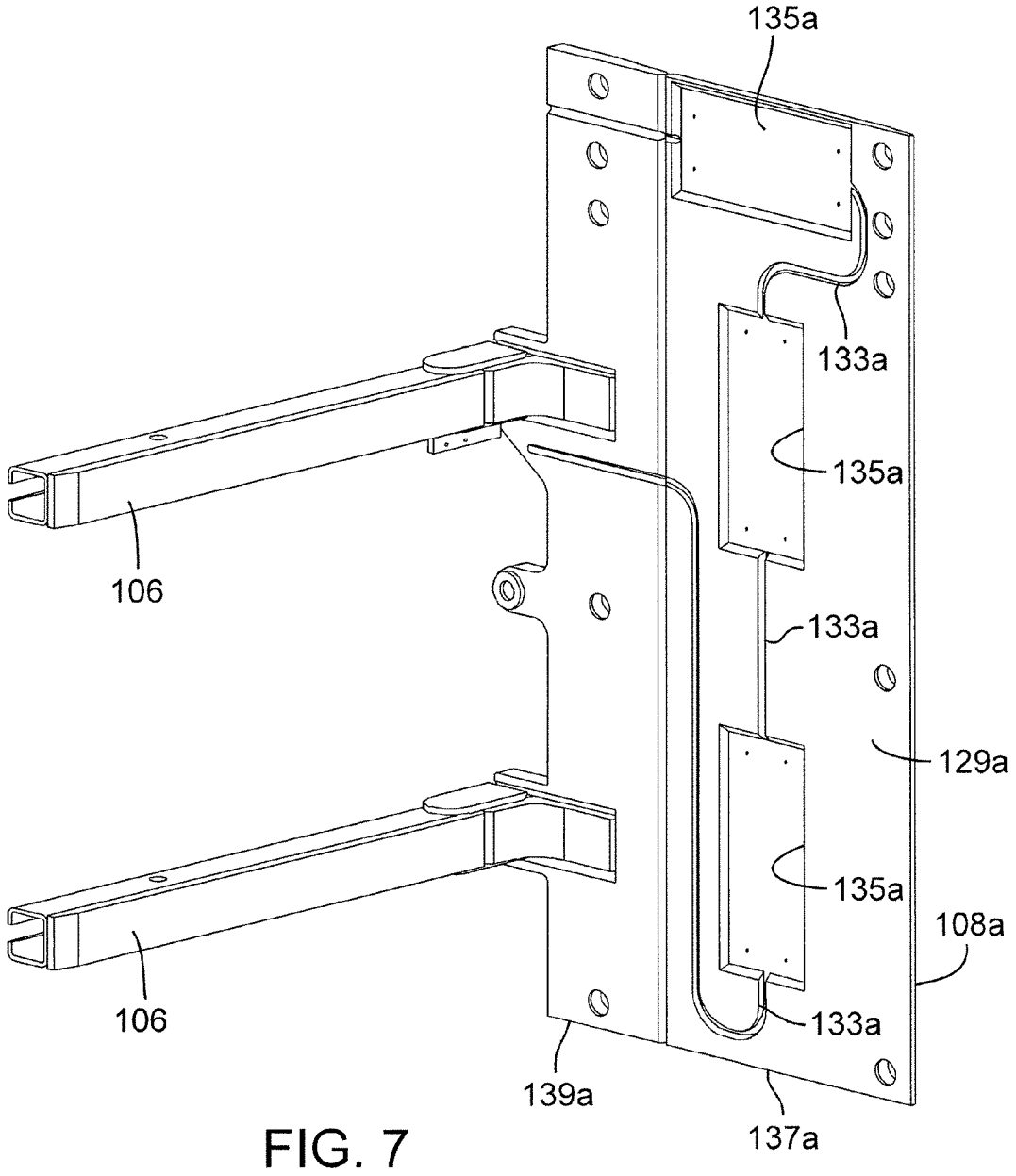
FIG. 7 is a perspective view of a left clamping arm showing more detail of its construction.

As best shown in FIG. 7 for the clamp arm 108A, there is a base plate 129A having a generally rectangular shape and formed with recesses 135A for each of the sensing bladders 126A, 128A, 130A, as well as channels 133A for the various fluid line segments 132A, 134A and 136A. The clamping arm 108B has a base plate 129B that is similar to the base plate 129A.

In operation, the sensing bladders 126A, 126B, 128A, 128B, 130A, 130B are positioned in the respective recesses and filled with a fluid, e.g., water, to a predetermined pressure. Although it is possible to use air or another gas in the bladders, better results are achieved using water or another liquid, in part because water-filed bladders are better able to resist the deflection in the clamping pads.

The clamping surface for each of the clamp arms 108A, 108B can include one or more contact pads. As best shown in FIG. 3, there are two contact pads for each clamp arm 108A, 108B in the illustrated implementation. Specifically, the contact pads 114A, 116A are connected to the back plate 129A with fasteners 149, and the contact pads 114B, 116B are connected to the back plate 129B with additional fasteners 149. The sensing bladders are sandwiched between the contact pads and the back plates with the pressure in the bladders tending to keep the contact pads spaced apart from the back plates. In a typical implementation, the bladders are filled to an initial pressure of approximately 5 psi, which causes the bladders to expand and separate the back plates and the contact pads by approximately 0.375 inches, while the fasteners 149 (typically, a bolt threaded through a spring and a nut 152), constrain the assembly. Thus, because of the bladders, the contact pads "float" relative to the back plates while they are maintained in alignment with the back plates by the fasteners. The fasteners also define a limit on how far the contact pad(s) can travel or deflect relative to the back plates. When the clamp arms are moved further inwardly, the pressure in the bladders increases to a threshold pressure, e.g., approximately 15 psi, which sends a pilot signal to a shutoff valve, and hydraulic flow to the hydraulic cylinders 110 is interrupted, which stops the clamp arms from moving inwardly.

Figure 4:
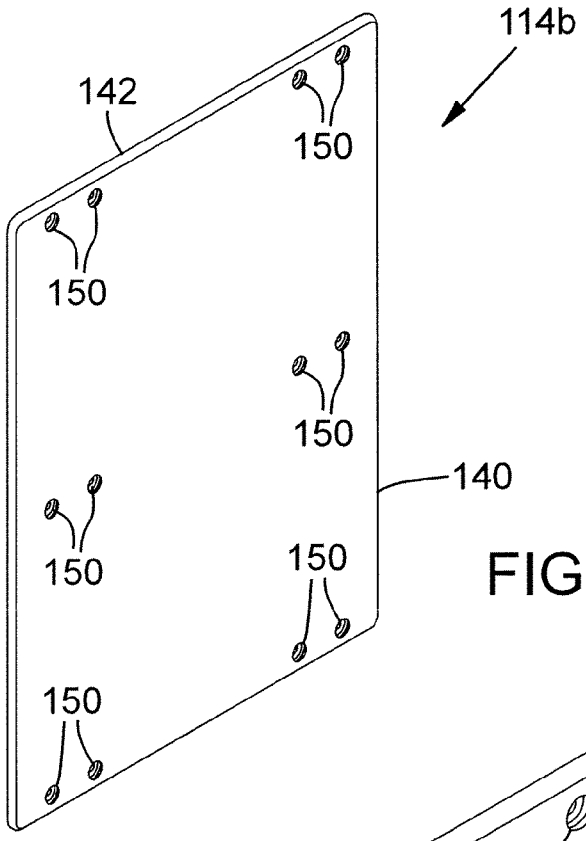
FIGS. 4 and 5 are perspective views of different clamping pads.
Figure 5:
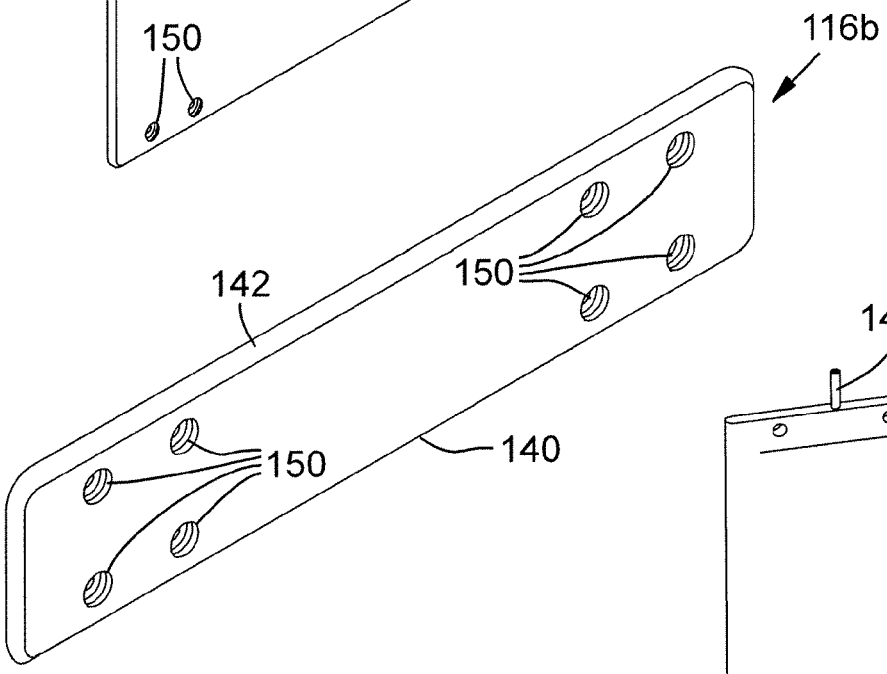
Figure 8A:
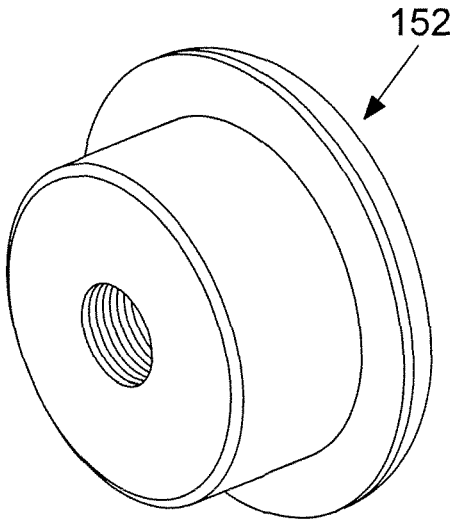
FIGS. 8A, 8B and 8C are bottom perspective, top plan and side views of a retaining nut.
Figure 8C:
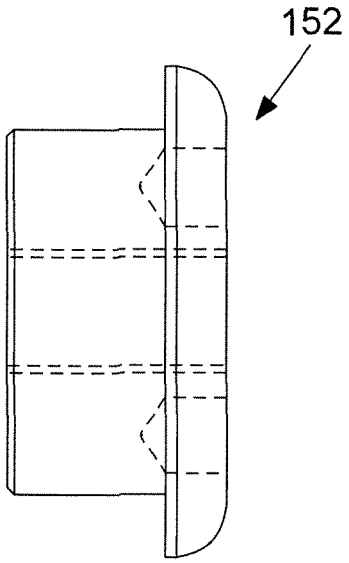
Figure 8B:
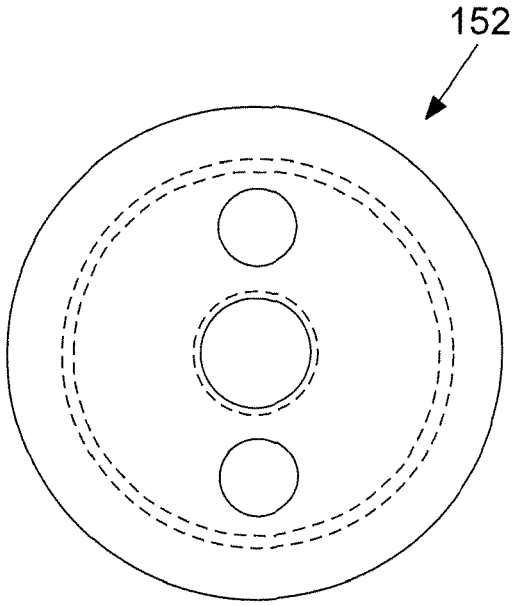

FIGS. 4 and 5 illustrate details of the construction of the contact pads. In FIG. 4, the contact pad 114B for the clamp arm 108B is shown. The contact pad 114B has an outer layer 140 formed of a resilient material, such as, e.g., rubber, and a relatively non-resilient material, such as aluminum, for a base 142. Similarly, FIG. 5 shows the contact pad 116B having the outer layer 140, the aluminum base 142 and mounting holes 150. FIGS. 8A, 8B and 8C show a portion of a suitable fastener element or nut 152 to receive the fasteners 149 extending through the mounting holes 150.

Figure 6:
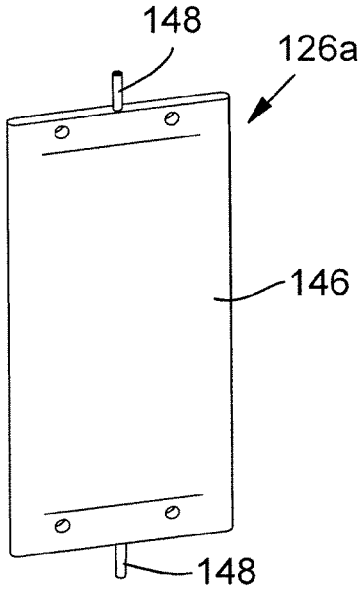
FIG. 6 is a perspective view of a pressure sensitive bladder used to sense pressure exerted on the clamping pads.

FIG. 6 is a perspective view showing details of the construction of the sensing bladders. For example, the sensing bladder 126A, which is representative, has an inflatable body 146 with tube extensions 148 by which fluid can be conveyed to or from the inflatable body 146. In one implementation, the sensing bladders, such as the sensing bladder 126A, are inflatable seals available from Dynamic Rubber, Inc. of Elk Grove, Ill.

Figure 9A:
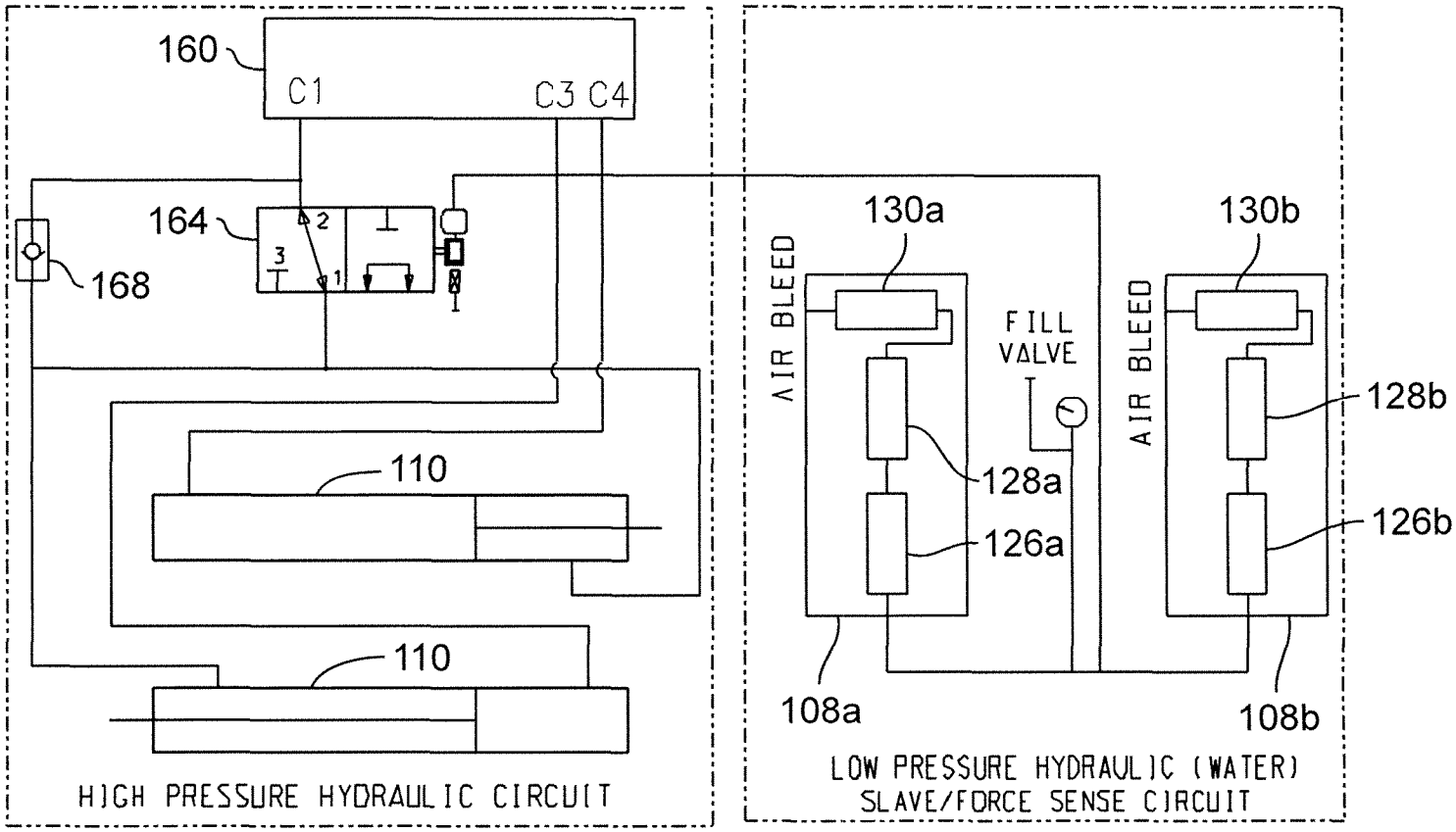
FIG. 9A is a schematic view of the high pressure hydraulic circuit for moving the hydraulic cylinders and the link with the low pressure hydraulic circuit for sensing forces exerted on clamp arms.

FIG. 9A is a schematic view showing the relatively high pressure hydraulic circuit suitable for moving the hydraulic cylinders 110, thereby moving the clamp arms 108A, 108B, as well as the relatively low pressure hydraulic circuit from which the pressures sensed by the bladders 126A, 128A, 130A on the clamp arm 108A and 126B, 128B, 130B on the clamp arm 108B are fed back to a directional valve 164 and used in controlling the hydraulic cylinders 110. There is a valve block 160 by which high pressure hydraulic fluid, e.g., from a source on the vehicle, is fed to the cylinders 110. The port C3 is connected to supply fluid to one of the hydraulic cylinders 110, and the port C4 is connected to supply hydraulic fluid to the other of the hydraulic cylinders 110. The port C1 is connected to the directional valve 164 that links the high pressure and low pressure circuits. The directional valve 164 is controlled by the pressure (or pressure difference) in the bladders. If the pressure in the bladders is below a predetermined threshold, then the valve allows the clamp arms to increase the clamping force applied to the load. If, however, the pressure in the bladders is above a predetermined threshold, then the valve 164 operates to prevent the cylinders from being moved to apply greater pressure to the load.

Figure 9B:
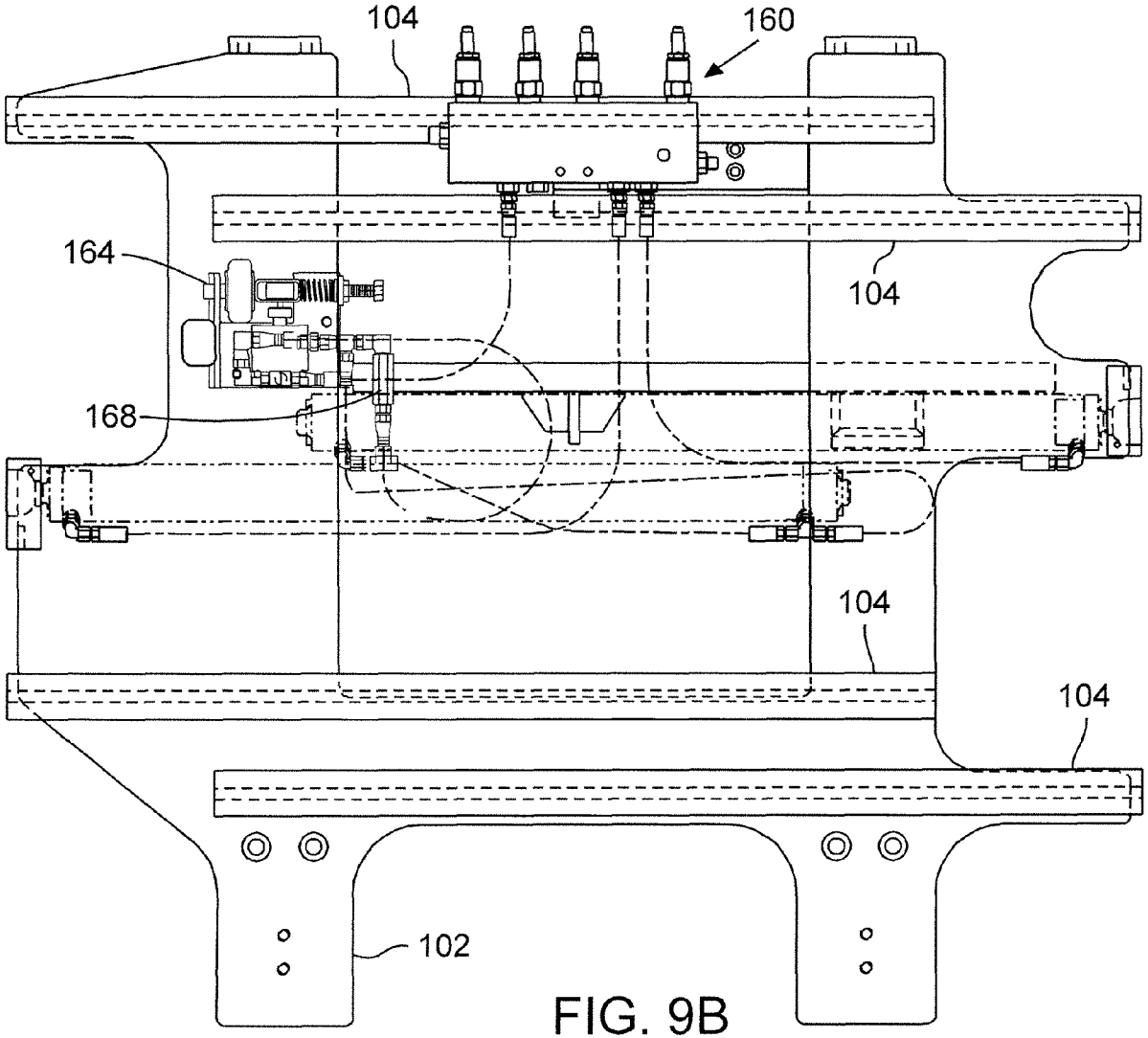
FIG. 9B is a front elevation view of a portion of the clamping assembly showing the hydraulic circuit.

FIG. 9B is a front elevation view of a mounting plate showing the positions of the valve block 160, the directional valve 164, the check valve 168 and the hydraulic line connections between these components.

Figure 10A:
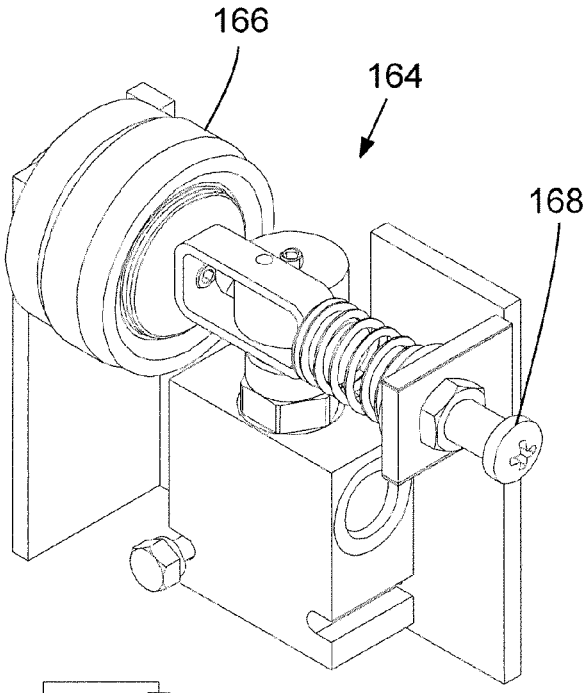
FIGS. 10A, 10B and 10C are perspective, elevation and plan views, respectively, of a directional valve used in the hydraulic circuit.
Figure 10B:
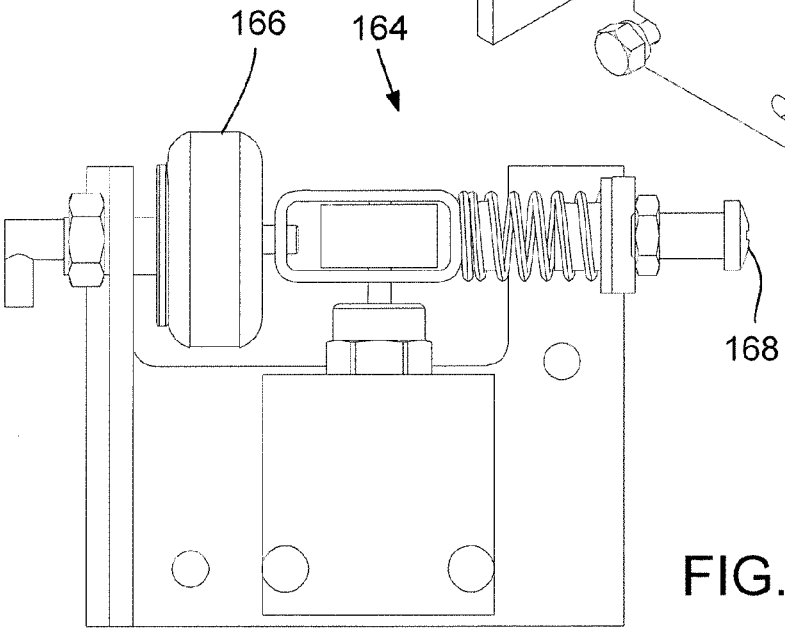
Figure 10C:
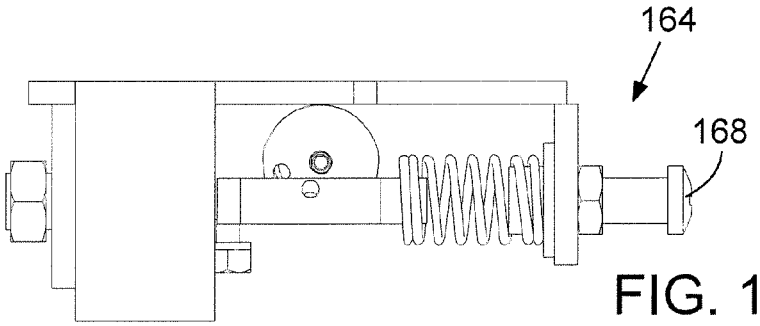
Figure 11B:
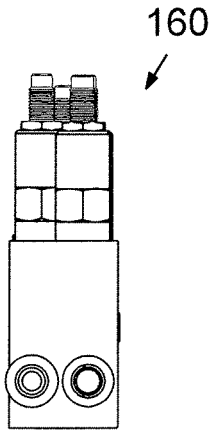
FIGS. 11A, 11B, 11C, 11D, 11E and 11F are various views of a valve block used in the hydraulic circuit.
Figure 11A:
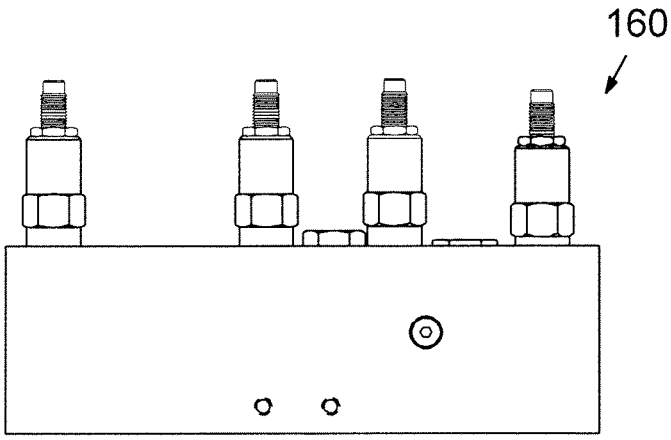
Figure 11E:
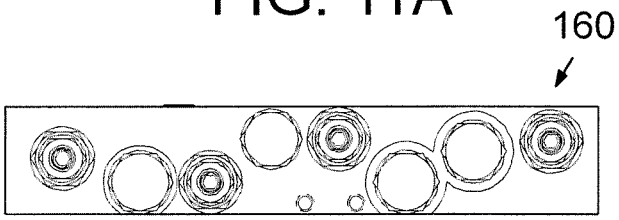
Figure 11F:
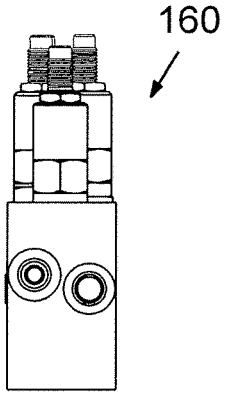
Figure 11C:
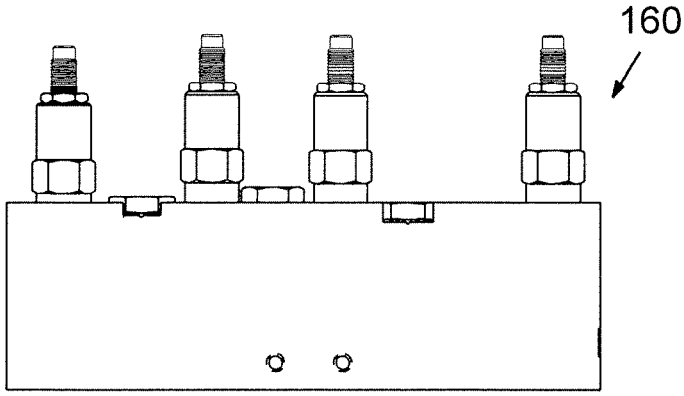
Figure 11D:
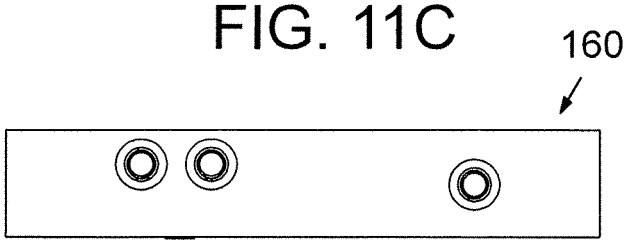

FIGS. 10A, 10B and 10C are perspective, front elevation and top plan views of a suitable directional valve assembly. In one implementation, the directional valve 164 is a manually-operated, three-way, two-position directional valve with two ports open and one port closed in the first position and all three ports closed in the second position. A Hydraforce MR10-31 valve or other suitable valve may be used. Instead of a handle, the directional valve 164 is fitted with a Numatics air spring 166 that is connected to the sensing bladders and serves to shut off flow to the hydraulic cylinders when actuated.

Figure 15:
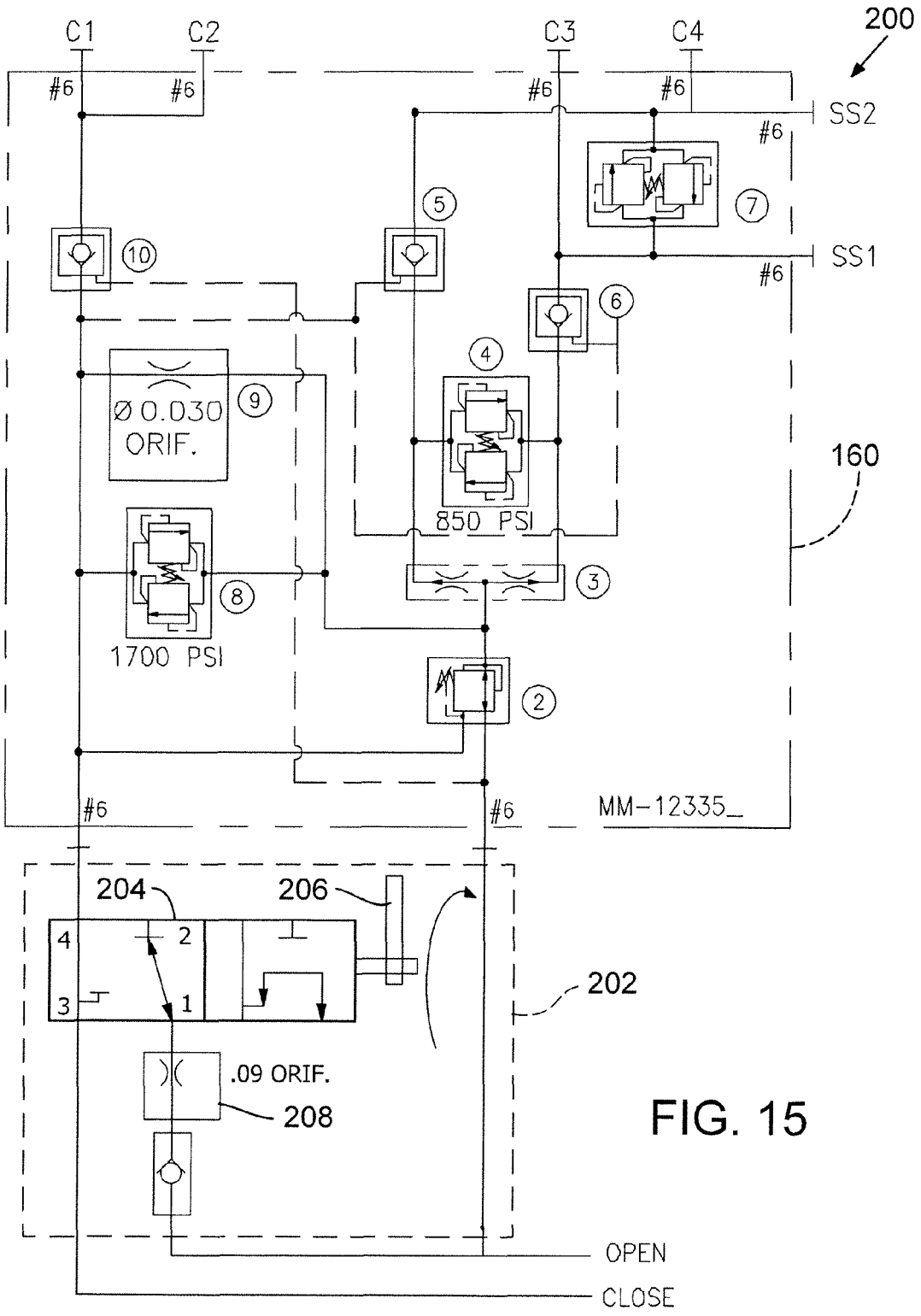
FIG. 15 is a schematic of an optional hydraulic circuit that is operable to sense and reduce the clamping force exerted on narrow loads.

FIGS. 11A, 11B, 11C, 11D, 11E and 11F are various views of the valve block 160. The valve block has four supply ports and four output ports. A suitable valve block is the Model MA-12336 from Pacific Power Tech. Further details of the valve block 160 are shown in FIG. 15. Two of the supply ports are indicated at SS1 and SS2, two of the supply ports are indicated at Open and Close, and the four output ports are indicated at C1, C2, C3 and C4.

Figure 12:
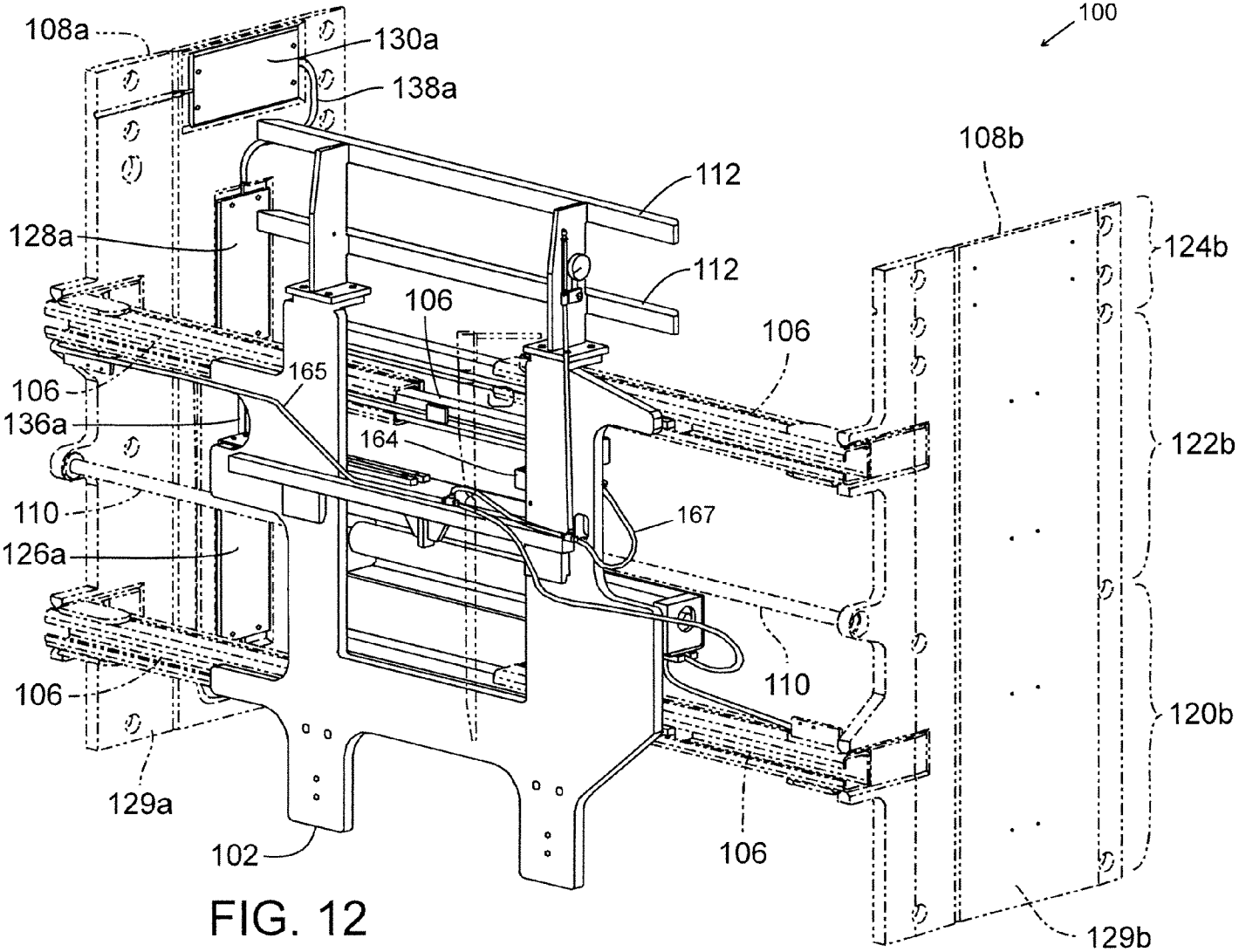
FIG. 12 is a perspective view schematically depicting elements of the hydraulic system and one of the clamping arms.

FIG. 12 is another perspective view of the clamping assembly 100. As described above, when the pressure in the bladders reaches a predetermined low pressure circuit threshold, a spool valve in the directional valve 164 (see also FIG. 9B) is caused to shift, which then stops the flow of high pressure hydraulic fluid to the actuators 110. The threshold pressure can be adjusted, e.g., by a threaded bolt on the directional valve 164. FIG. 12 shows the connections between the sensing bladders in the clamp arm 108*a*, such as the connections 165, 167, and the directional valve 164 and the hydraulic actuator 110.

Figure 13:
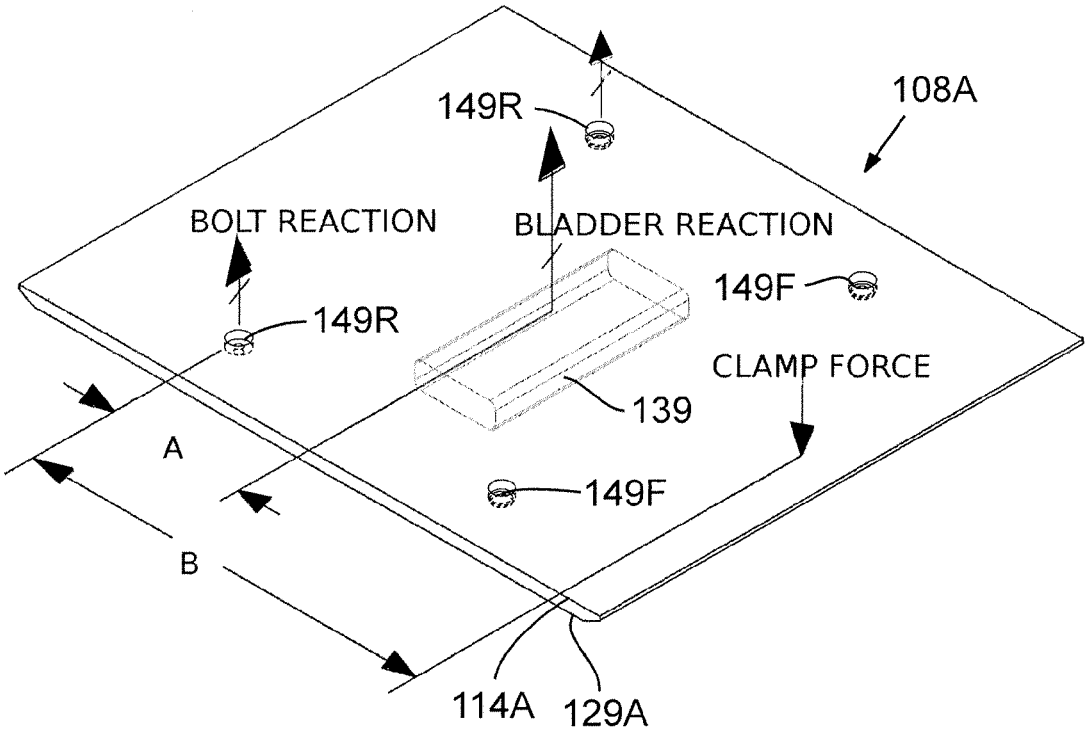
FIG. 13 is a plan view of one of the clamping arms.

FIG. 13 is an enlarged view of a portion of the clamp arm 108A laying on its side, which is shown schematically to illustrate how the system responds and applies forces proportional to the area of the clamping pad that is engaged. At rest, the clamping pad 114A in FIG. 13 is kept separated from the back plate 129A by the pressure in one or more bladders. In the illustration of FIG. 13, a single sensing bladder 139 is shown for simplicity. A single sensing bladder is equivalent to two sensing bladders connected together, but better results may be achieved if multiple sensing bladders that are interconnected but separated are used to provide better resistance to deflection in the clamping pad experienced under typical loading conditions.

Figure 14A:
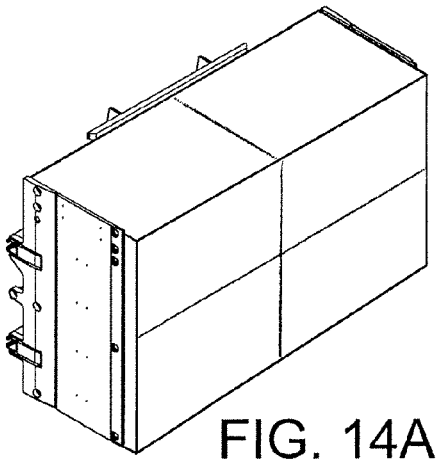
FIG. 14A is a perspective schematic view showing the clamping assembly engaged against a load having a height and depth at least as great as the height and depth of the clamping arms and thus is subject to a maximum clamping force.
Figure 14C:
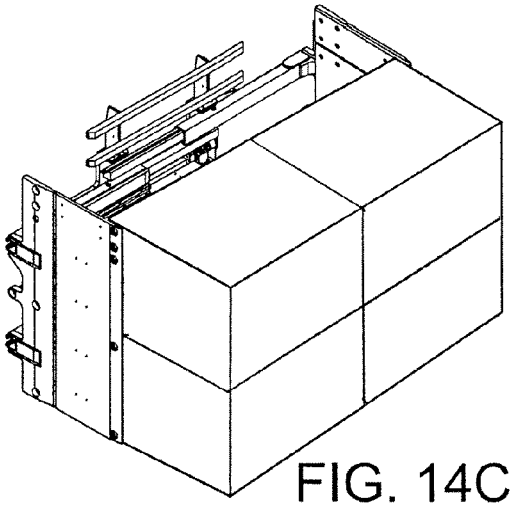
FIG. 14C is a perspective view showing the clamping assembly engaged with a load at least as high as the height of the clamping arms, but the clamping arms are engaged only at their tips, so the resulting force exerted on the load is a fraction of the clamp force when the clamping arms are fully engaged.

FIG. 13 illustrates a "Clamp" Force exerted only by the tip of the clamping pad 114A, such as when the system is used to engage only a portion of a carton (e.g., see FIG. 14C). At equilibrium, the Clamp Force exerted by the clamping pad 114A near its tip on the carton (not shown) is balanced by a "Bladder Reaction" Force applied to the clamping pad near its center. The clamping pad 114A has been moved against the outer extents of rear fasteners 149R, so they limit the pad's further movement at that end. Thus, the Clamp Force is applied at a distance B from a pivot axis extending through the rear fasteners 149R. The Clamp Force is counteracted by the Bladder Reaction Force applied at a distance B from the pivot axis. Accordingly, at equilibrium, the Bladder Reaction Force is equal to the Clamp Force multiplied by the distance A divided by the distance B. For a Bladder Reaction Force of 1500 pounds applied at a distance A of 12 inches from the rear fasteners, a Clamp Force of 600 pounds is exerted at a distance B of 30 inches from the rear fasteners. In this way, a smaller Clamp Force is applied when the engaged area of the clamp arms is smaller and when the engaged area is more distant from the bladder. It should be noted that in this example, the forward fasteners 149F do not apply any force because their outer extents are not engaged with the clamp pad. Rather, the clamp pad 114A has travelled inwardly along the fasteners 149F and moved closer to the back plate 129A.

FIGS. 14A, 14B, 14C and 14 D are perspective views of the clamping assembly 100 in use to engage and lift loads of different sizes and from different positions on the clamping assembly.

In FIG. 14A, the clamp arms 108A and 108B are engaged to their full depth, and the load is at least as high as the clamp arms. Thus, all of the area of contact pads 114A, 116A on the clamp arm 108A and contact pads 114B, and 116B on the clamp arm 108B is engaged with the surface of the load. Therefore, when the operator moves the clamp arms to a closed position as shown, all six of the sensing bladders will reach the threshold pressure, thus signaling the directional valve 164 to apply a maximum clamping force to the load.

Figure 14B:
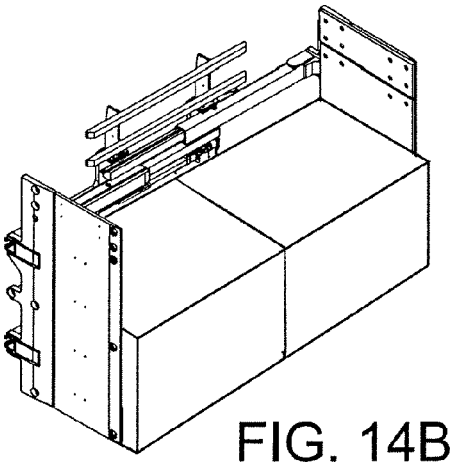
FIG. 14B is a perspective view showing a load having a short height, causing a clamp force proportional to the load's height to be generated.

In FIG. 14B, the clamp arms 108A, 108B are engaged to their full depth, but only a portion of each lower contact pad 114A, 114B is in contact with the load, and the upper contact pads 116A, 116B are not in contact with the load. Such a condition, which arises in the case of a "short carton," results in a lower Clamp Force that is roughly proportional to the height of the carton. Similar to the description of the force balance in FIG. 13 for the tip loading condition, the short carton loading condition of FIG. 14B produces less force because less of the lower contact pads 114A, 114B are engaged. The clamping force deflects the contact pads in the lower engaged regions towards their respective back plates, whereas the upper regions remain undeflected and constrained by the fasteners.

FIG. 14C shows a load that is at least as high as the height of the clamp arms 108A, 108B, but the load is engaged only at the tips of the clamp arms. This is the condition described above in connection with FIG. 13. Thus, the resulting force applied to the load is about half of the fully engaged maximum clamp force. It is important to allow the clamping assembly 100 to be used to clamp loads only to a partial depth such that operators can use it to pull one carton away from a stack of closely packed cartons (referred to as "knifing").

Figure 14D:
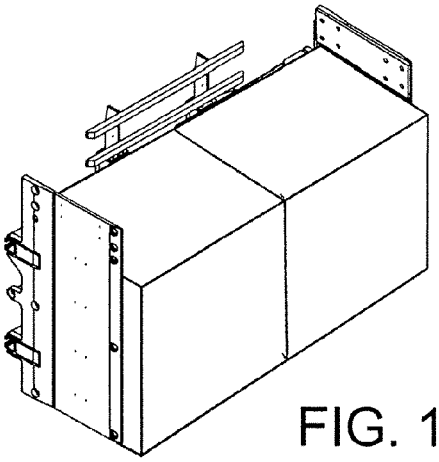
FIG. 14D is a perspective view showing the clamping assembly engaged with a load that does not contact or only minimally contacts the uppermost load sensing pad of the clamp arm, and thus causes a fractional clamping force to be exerted against the carton.

In FIG. 14D, the load engages the full depth of the clamp arms 108A, 108B, but extends only as high as the height of the lower contact pads 114A, 114B. As a result, the contact pads 116A, 116B do not experience any exerted force from the load. Therefore, the resulting force is about three quarters of the fully engaged maximum clamp force. Conveniently, whether to have multiple vertically aligned contact pads on each clamp arm, and, if present, how they should be sized relative to each other, can be determined based on the types of loads expected for the system. For example, the lower clamping pads, which are presumably always engaged, can be sized according to a typical carton height or multiple thereof. Accordingly, the lower clamping pads can be sized at 24 inches in height (e.g., if the typical carton height is 24 inches if two rows of 12-inch high cartons is a typical load).

Thus, if the system is provided with multiple vertically aligned contact pads as described, the system decreases the clamping force in a second way if the total clamping area is not engaged with the load. For any contact pad that is not engaged with the load, there is zero clamp force applied by that clamp pad and its associated bladders. For any other contact pad that is partially in contact with the load, the clamping force is decreased roughly proportionally as described above in connection with FIG. 13.

In some implementations, the system is designed to allow an operator to apply a constant force that is automatically and passively adjusted to provide the appropriate clamping force for the specific load engaged by the clamp arms. For example, in one implementation, the system is configured to decrease the constant applied force to an appropriate clamping force (1) if there is no load engaged between an opposed pair of contact pads, (2) if the load engaged between a pair of opposed contact pads is shorter in height than the contact pads and (3) if the load engaged between a pair of opposed contact pads in shallower in depth than the contact pads. In this way, the operator need not adjust the applied force according to every variation in load, and instead the applied force is adjusted as necessary automatically and passively.

It can be seen from FIGS. 13, 14B, 14C and 14D that the system applies a roughly proportional clamping force according to how much of the clamping pad area is engaged, as well as where the engaged area is located relative to the bladders or sensing elements. In this way, the maximum clamping force is generally applied only when the full area of the clamping pads are engaged. Similarly, loads engaged only at the tips of the clamp arms are automatically clamped with just a fraction of the available maximum clamping force.

Testing was conducted with another commercial fixture to verify the above results. The commercial fixture, which includes a load cell, is clamped between the left and right clamp arms, and the resulting force is noted. Over a range of different clamping scenarios, these results with the commercial fixture matched well. In other testing, simulated loads were used to establish the performance of the clamping assembly 100 described above. These loads included microwaves (of two different sizes), refrigerators and washers. The load testing of refrigerators included clamping two refrigerators side by side with additional weight added to the top of the cartons to simulate the weight of a load of four refrigerators. The testing of washer loads included carrying one, two, three and four washers at one time. Dishwashers that were damaged by conventional equipment were also studied.

As a result, the following Table 1 of acceptable clamp forces was developed as a guide for use in training operators and predicting acceptable clamp forces for other types of loads. For the various types of appliance cartons shown in the table, estimated acceptable clamping forces are specified according to the number of cartons placed between the clamp arms ("3 wide," "2 wide" or "1 wide"), as well as the number of rows of cartons being lifted at one time, i.e., "One High," "Two High" and "Three High." There is also a specified "Tip Load" which is the acceptable clamping force to be applied when only the tip of the clamp arms is engaged. As can be seen, a maximum clamp force exerted per carton or "box" that must be observed is also specified.

TABLE 1

| | 1 High | 2 High | 3 High | |
|---|---|---|---|---|
| Microwaves 14" × 17" × 24" | | | | |
| 3 Wide | 580 LBF | 942 LBF | | Maximum |
| 2 Wide | 615 LBF | 990 LBF | 1164 LBF | Clamp Force |
| Tip Load | 600 LBF | 625 LBF | 650 LBF | Per Box = 615 LBF |

TABLE 1-continued

| | 1 High | 2 High | 3 High | |
|---|---|---|---|---|
| Microwaves 19" × 19" × 24" | | | | |
| 3 Wide | 660 LBF | 1100 LBF | | Maximum |
| 2 Wide | 700 LBF | 1150 LBF | 1450 LBF | Clamp Force |
| Tip Load | 610 LBF | 635 LBF | 800 LBF | Per Box = 700 LBF |
| Dishwashers | | | | |
| 3 Wide | 900 LBF | 1350 LBF | | Maximum |
| 2 Wide | 950 LBF | 1380 LBF | | Clamp Force |
| 1 Wide | 1000 LBF | 1400 LBF | | Per Box = |
| Tip Load | 650 LBF | 800 LBF | | 1000 LBF |
| Washers | | | | |
| 2 Wide | 1020 LBF | 1400 LBF | | Maximum |
| 1 Wide | 1100 LBF | 1450 LBF | | Clamp Force |
| Tip Load | 650 LBF | 800 LBF | | Per Box = 1000 LBF |
| Dryers | | | | |
| 2 Wide | 1020 LBF | 1400 LBF | | Maximum |
| 1 Wide | 1100 LBF | 1450 LBF | | Clamp Force |
| Tip Load | 650 LBF | 800 LBF | | Per Box = 1100 LBF |
| Ranges | | | | |
| 2 Wide | 1020 LBF | 1400 LBF | | Maximum |
| 1 Wide | 1100 LBF | 1450 LBF | | Clamp Force |
| Tip Load | 650 LBF | 800 LBF | | Per Box = 1100 LBF |
| Chest Freezers | | | | |
| 2 Wide | 1000 LBF | 1400 LBF | | Maximum |
| 1 Wide | 1050 LBF | 1450 LBF | | Clamp Force |
| Tip Load | 650 LBF | 800 LBF | | Per Box = 1050 LBF |
| Upright Freezers | | | | |
| 2 Wide | 1400 LBF | 1400 LBF | | Maximum |
| 1 Wide | 1480 LBF | 1480 LBF | | Clamp Force |
| Tip Load | 650 LBF | 800 LBF | | Per Box = 1480 LBF |
| Refrigerators | | | | |
| 2 Wide | 1400 LBF | 1400 LBF | | Maximum |
| 1 Wide | 1480 LBF | 1480 LBF | | Clamp Force |
| Tip Load | 650 LBF | 800 LBF | | Per Box = 1480 LBF |

In one implementation, the contact pads 114A, 114B are approximately 48 inches high and 34 inches deep. The contact pads 116A, 116B are approximately 7 inches high and 34 inches deep. Other dimensions are, of course, possible. It has been found that having second row contact pads 116A, 116B assists in clamping loads when the second (or other upper) row of cartons is slightly out of alignment with the row directly beneath. The second row clamp pads 116A, 116B can move or deflect independently of the clamp pads 114A, 114B and thus accommodate the misalignment.

In some situations, it is desirable to configure the system to apply a lower clamping force under certain pre-determined conditions. For example, the system can be configured to apply a lower clamping force when a narrower load is detected. In some cases, a lower clamping force is sufficient when handling a load having a width of only a single carton (by way of contrast, the illustrated loads in FIGS. 14A-14D are two cartons wide).

Figure 17A:
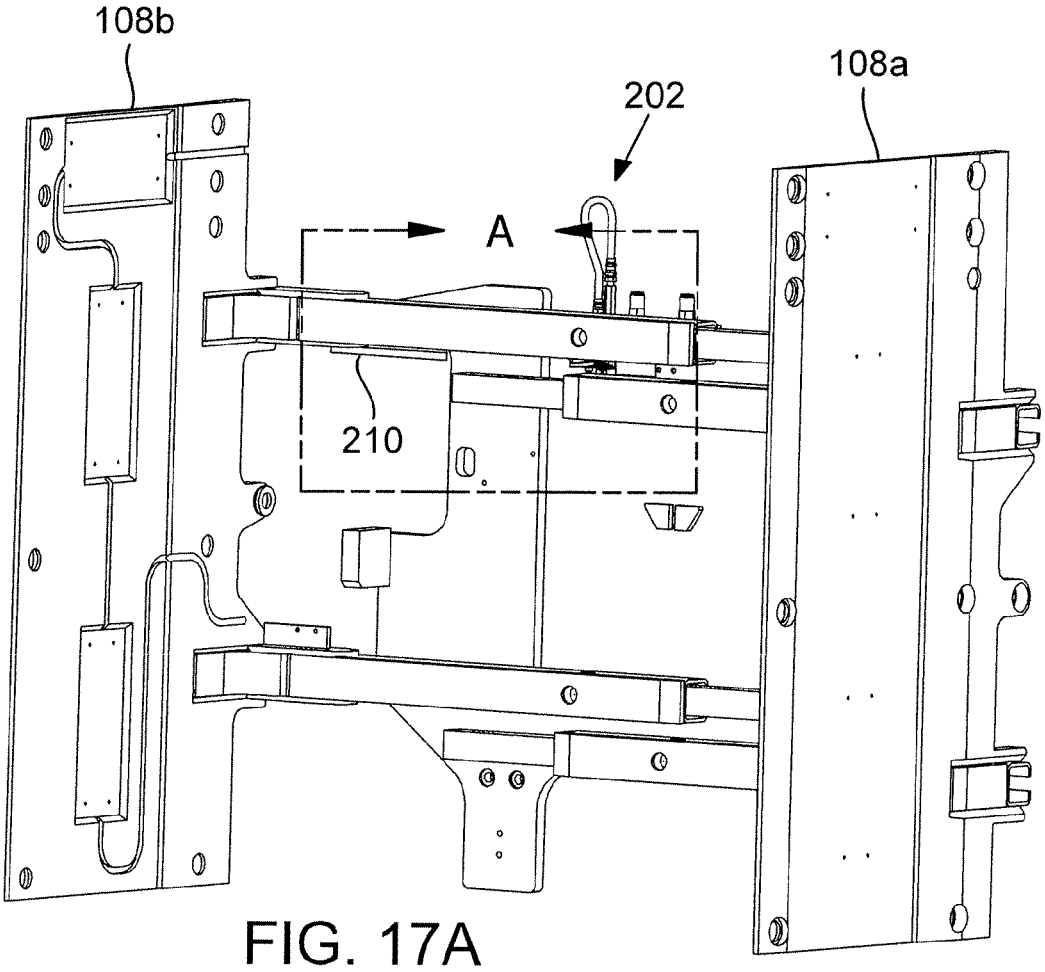
FIGS. 17A and 17B are perspective views of a clamping assembly having a member positioned to actuate the diverter valve as the clamp arms are moved closer than a predetermined width.
Figure 17B:
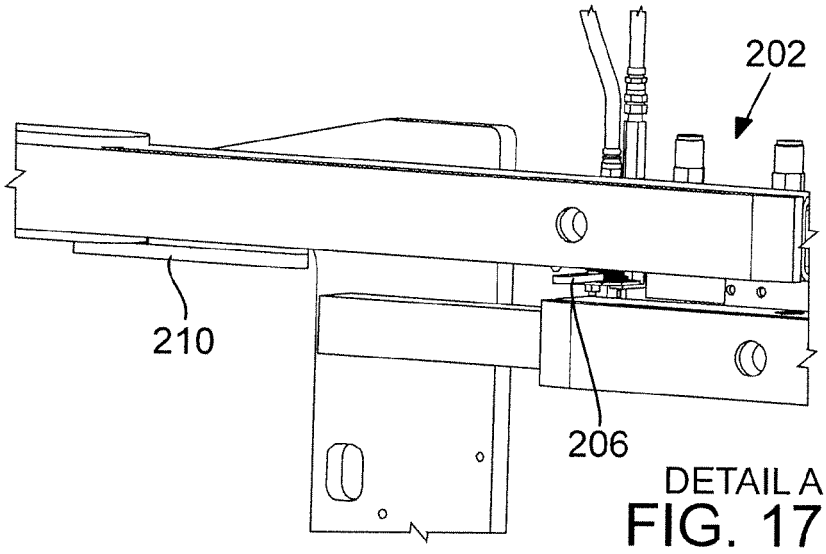
Figure 19:
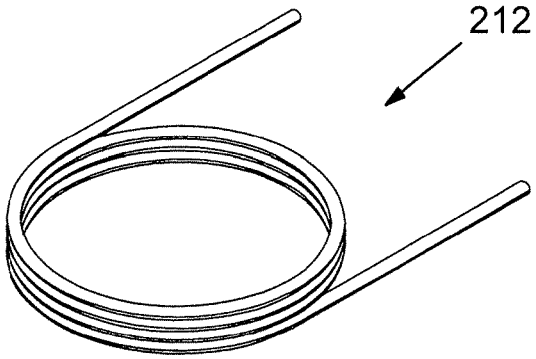
FIG. 19 is a perspective view of a spring used with the actuator arm of FIG. 18.
Figure 20A:
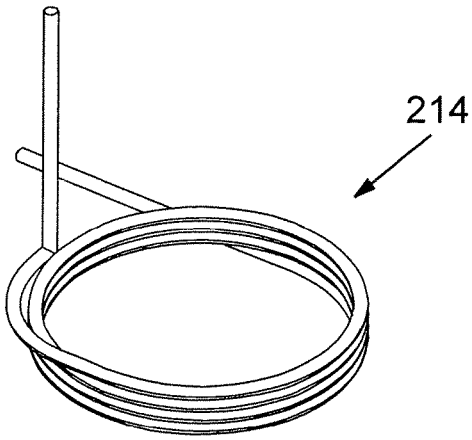
FIGS. 20A-20D are perspective, top plan, front elevation and right side elevation views of another spring used with the actuator arm of FIG. 18.
Figure 20B:
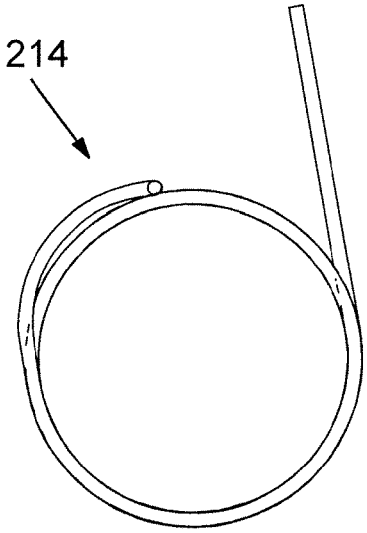
Figure 20C:
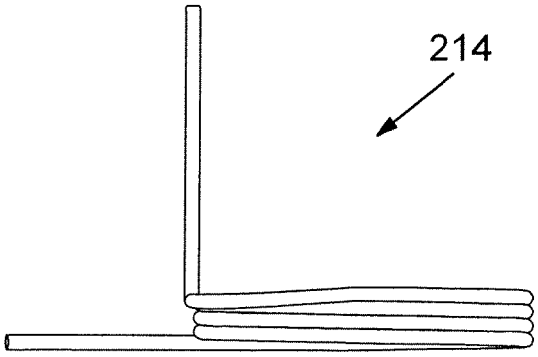
Figure 20D:
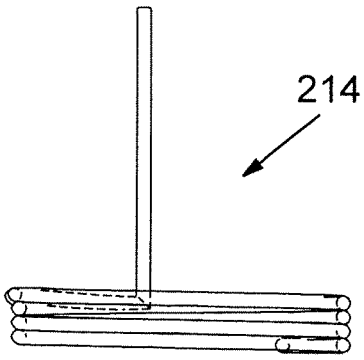

FIG. 15 is a schematic of an optional hydraulic circuit 200 that includes an optional diverter valve 202 connected to the valve block 160. The diverter valve 202 has a valve body 204 with an attached actuator lever 206 that is operable to change the two-position valve from a close position (as shown in FIG. 15) to a bleed path position (i.e., using the right position of the two-position valve). It is noted that the valve port "2" is not used. In the close position, the valve block 160 continues to operate and apply force to loads as described above. In the bleed path position, the diverter valve 202 provides a bleed or leak path to reduce flow to the valve block 160, which thereby reduces the forces (clamping loads) that are applied. By way of comparison, the applied clamping forces under this approach are about 50% less than the "1 Wide" values shown in Table 1 for a system without a diverter valve. In the illustrated implementation, the diverter valve 202 is changed to the bleed path position when the actuator lever 206 is rotated by contact with another component as the clamp arms 108A, 108B are moved towards each other. Specifically, the actuator lever 206 can be positioned so that it is actuated as the separation distance between arms 108A, 108B decreases to about 42 inches. A cam bar 210 or other suitable structure can be positioned as shown in FIGS. 17A and 17B such that relative movement, and eventually contact, between the cam bar 210 and the actuator lever 206 causes the actuator lever 206 to be moved. In this way, the diverter valve 202 is actuated to drain some of the oil through an orifice 208 on the return line, thereby lessening the available pressure in the circuit. Instead of the orifice 208, a relief valve or other suitable component can be substituted. Instead of mechanical actuation, it would also be possible to use a limit switch or an electronic sensor to trigger actuation of the diverter valve 202.

Figure 16:
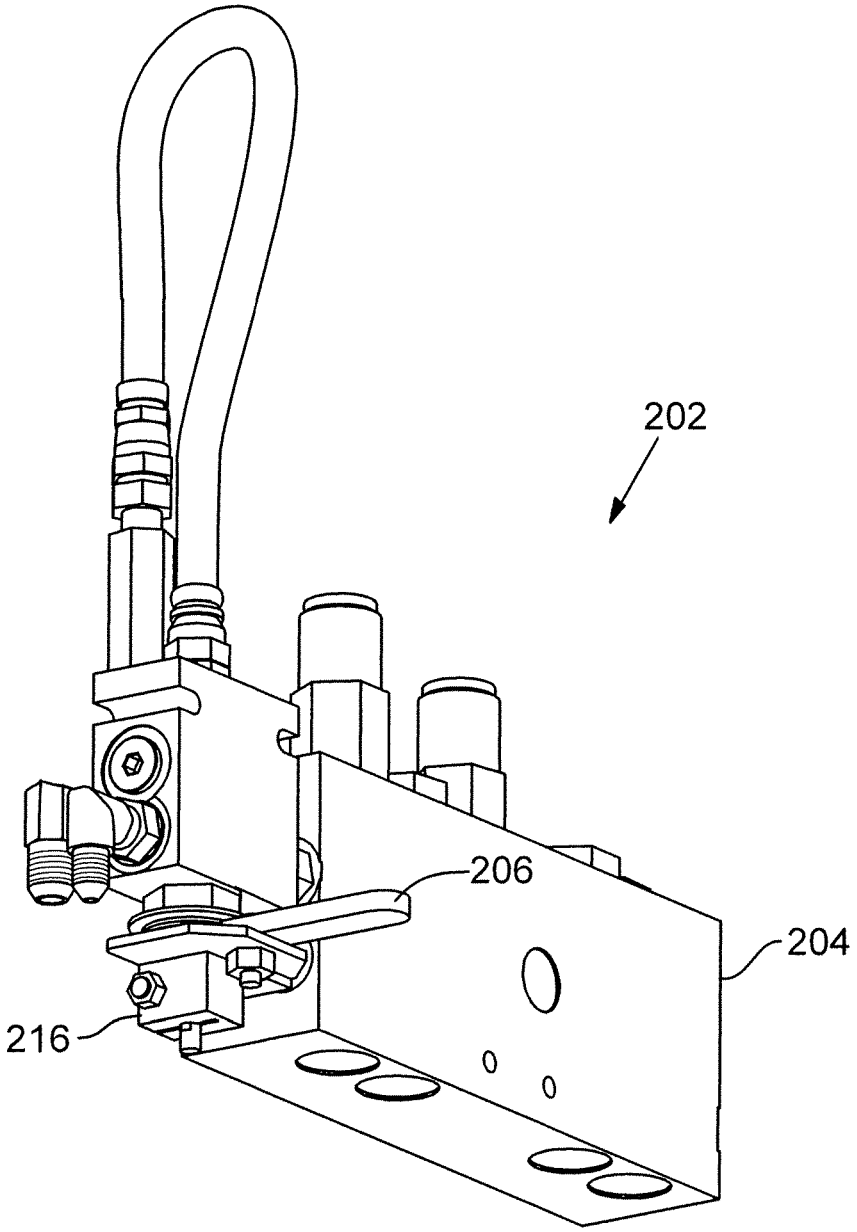
FIG. 16 is a perspective view of a diverter valve assembly as configured for operation in the circuit of FIG. 15.
Figure 18:
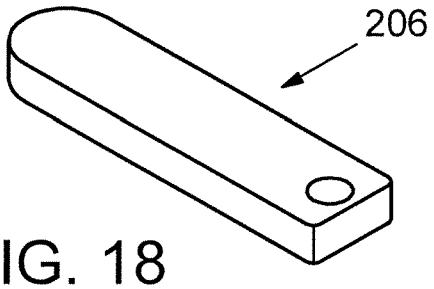
FIG. 18 is a perspective view of an actuator arm of the diverter valve assembly of FIG. 16.
Figure 21A:
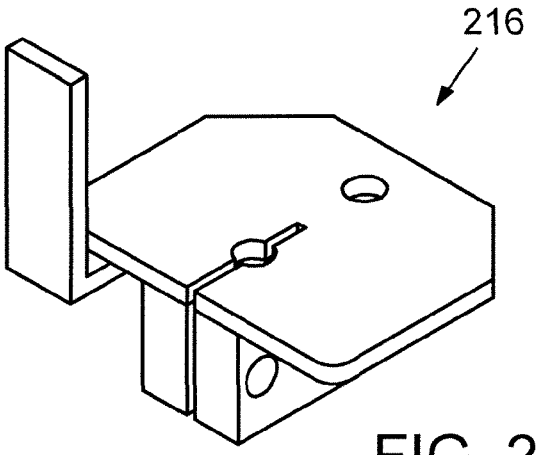
FIGS. 21A-21C are perspective, top plan and front elevation views of a weldment used with the actuator arm of FIG. 18.
Figure 21B:
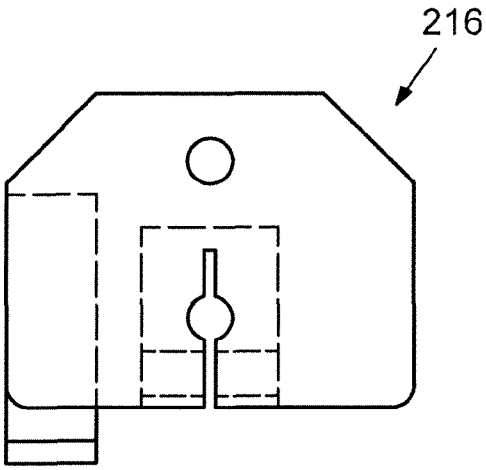
Figure 21C:
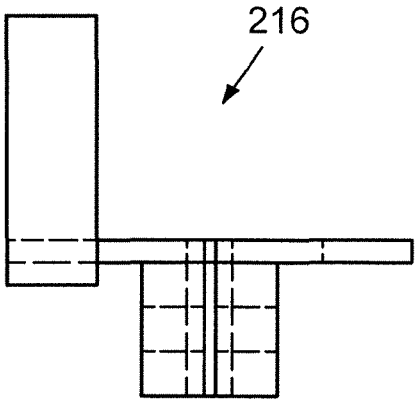

FIG. 16 is a perspective view of the diverter valve 202 showing the valve body 204 with the actuator lever 206 attached. FIG. 18 is a perspective view of the actuator lever 206. FIGS. 19 and 20A-20D are views of two different springs 212, 214 used to bias the actuator lever 206 into position. FIGS. 21A-21C are views of a weldment 216 for mounting the actuator lever 206 to the valve body 204

Figure 22:
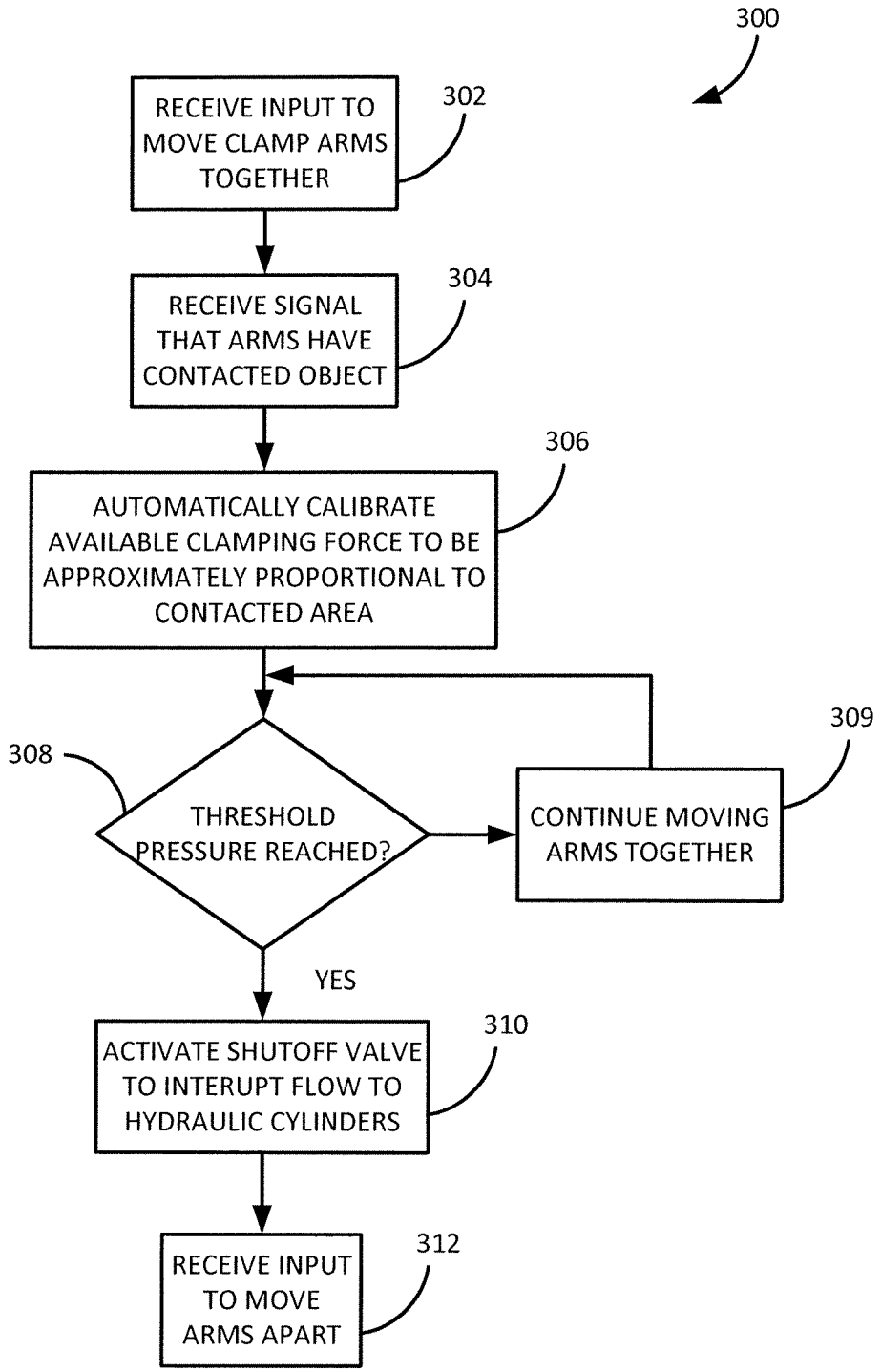
FIG. 22 is a flow chart of a method for applying a desired clamping force.

In FIG. 22, steps of a method 300 for applying a desired clamping force are shown. In step 302, an input to move the clamp arms 108A, 108B towards each other is received. This input can be in the form of movement of a lever by the operator.

In step 304, the system receives a signal that the arms have contacted an object, i.e., at least one of the arms has contacted a side of a load or, if no object is present, the arms have contacted each other.

In step 306, while the arms continue to move together and pressure is increasing, the system automatically calibrates the available clamping force to be applied to be approximately proportional to the area of the pads on the arms that is in contact with the load. In step 308, it is determined whether the threshold pressure in the contacting bladders has been reached.

If the threshold pressure has not been reached ("No" branch), then the arms are allowed to continue moving towards each other, and the process flow loops back to step 308.

If the threshold pressure has been reached ("Yes" branch), then the automatic shutoff valve is triggered (step 310), which interrupts flow of hydraulic fluid to the hydraulic cylinders, and the arms stop moving together.

In step 312, the system receives an input to move the arms apart, e.g., when the operator desires to release the load.

Overall, the described approach that passively sets an appropriate clamping force based on the fraction of clamp arm area that is engaged and/or the width of the load provides for ease of use among operators. In general, operators can move the clamp arms toward each other at full speed with manual adjustment, and the system will respond to apply an appropriate clamping force. In general, operators will not need to engage the multi-position pressure regulators in any particular setting before beginning a lifting sequence because in the calibrated system, the force to be applied to the load will be sensed and controlled to be appropriate.

Among the load variations for which the system compensates is the difference in resistance presented by a row of two cartons (more resistance, so clamping force can be higher) vs. a row of a single carton (less resistance, so clamping force must be lower). The system also compensates for loads of different heights, and tip-only loads vs. full-depth loads. Such compensation is provided on a continuous basis, as opposed to only in discrete increments. Because the system ensures that an appropriate clamping force is applied, few cartons and their contents are damaged, and it is easier to train operators in using lift trucks to move such cartons.

In view of the many possible embodiments to which the disclosed principles may be applied, it should be recognized that the illustrated embodiments are only preferred examples and should not be taken as limiting in scope. Rather, the scope of protection is defined by the following claims. I therefore claim all that comes within the scope and spirit of these claims.

I claim:

1. A clamping assembly for a load-carrying vehicle, comprising:

first and second opposing clamp arms movable towards and away from each other to contact and exert a clamping force on a load sufficient for lifting and transporting the load, each of the first and second clamp arms having a clamping pad movably coupled at a pivot point to an outer back plate;

at least one hydraulic actuator configured to move the first and second clamp arms towards and away from each other and to engage and exert the clamping force on the load;

at least one first clamp arm sensing element positioned on the first clamp arm between the respective clamping pad and the outer back plate and responsive to forces exerted on the respective clamping pad;

at least one second clamp arm sensing element positioned on the second clamp arm between the respective clamping pad and the outer back plate and responsive to forces exerted on the respective clamping pad;

wherein each of the first and second clamp arm sensing elements is configured to sense a magnitude of an applied force exerted on the respective clamping pad by contact between the respective clamping pad and the load based on at least a distance of the applied force from the respective pivot point and a portion of an area of the respective clamping pad in contact with the load, thereby allowing the clamping assembly to passively adjust the clamping force to balance the applied force, and wherein the first and second clamp arm sensing elements comprise bladders filled with liquid that support the respective clamping pads, further comprising a valve connected to the at least one hydraulic actuator and to the first and second clamp arm sensing elements, and wherein the valve is configured to shut off flow to the hydraulic actuator when the valve receives a pressure sense signal based on a pressure of the liquid in the bladders exceeding a predetermined threshold, thereby preventing the clamping force from increasing.

2. The clamping assembly of claim 1, wherein the respective clamping pads are generally planar and configured for positioning in a generally upright position.

3. The clamping assembly of claim 1, wherein the first clamp arm and the second clamp arm are configured to be positioned approximately vertically, and wherein the first clamp arm sensing elements and the second clamp arm sensing elements each include at least a base sensing element and an intermediate sensing element, respectively, wherein when the first and second clamp arms are oriented vertically, the respective base sensing elements are positioned nearest to respective lower edges of the first and second clamp arms, and the respective intermediate sensing elements are spaced above the base sensing elements.

4. The clamping assembly of claim 3, further comprising a respective upper sensing element spaced vertically above each intermediate sensing element.

5. The clamping assembly of claim 1, wherein the sensing elements are configured to detect a load that is engaged by less than the clamping surface height of the first and second clamping surfaces.

6. The clamping assembly of claim 1, wherein the clamping arms are configured to exert about 50% of a maximum clamping force if the sensing elements indicate that only distal ends of the first and second clamping pads are engaged with the load.

7. The clamping assembly of claim 1, further comprising a diverter valve circuit operable to decrease the adjusted clamping force when a load width is less than a predetermined width.

8. The clamping device of claim 7, wherein the diverter valve circuit comprises a diverter valve triggered by an actuator lever mounted to a moving part of the assembly that contacts a stationary part positioned at the predetermined width, thereby causing the diverter valve to divert flow away from the first and second clamp arms and decrease the adjusted clamping force.

9. The clamping assembly of claim 1, wherein the distal ends of the clamping pads are coupled to float relative to the respective base plates with fasteners that maintain approximate alignment between the clamping pads and the base plates.

10. The clamping assembly of claim 1, wherein the bladders on the first and second clamp arms are connected in series to each other within a circuit, thereby allowing liquid pressure within the bladders to be equalized, and wherein the circuit further comprises an air bleed for the bladders on the first clamp arm, an air bleed for the bladders on the second clamp arm, a fill valve for receiving liquid to fill the bladders and a connection between the circuit and the valve connected to the at least one hydraulic actuator.

11. The clamping assembly of claim 1, further comprising nesting guide bars and slide arms, the slide arms being movable relative to the guide bars to guide the first and second clamp arms during movement towards and away from each other.

12. The clamping assembly of claim 1, wherein each of the first and second clamp arms comprises a major contact pad comprising a majority of a clamp arm area and a minor contact pad comprising a minority of the clamp arm area.

13. The clamping assembly of claim 12, wherein the major contact pad is approximately 48 inches in height.

14. The clamping assembly of claim 12, wherein the minor contact pad is approximately 7 inches in height.

15. The clamping assembly of claim 12, wherein the first and second clamp arms define a clamping depth of about 34 inches.

16. The clamping assembly of claim 1, wherein the fulcrum for each of the first and second clamp arms is defined at a fastener connection between the respective clamping pad and back plate adjacent proximal ends thereof.

17. The clamping assembly of claim 1, wherein the at least one first clamp arm sensing element and the at least one second clamp arm sensing element comprise electronic pressure sensors.

18. The clamping assembly of claim 17, wherein the electronic pressure sensors comprise piezoelectric sensors.

19. The clamping assembly of claim 1, wherein the bladders are filled with water.

20. The clamping assembly of claim 1, wherein the valve comprises a directional valve.

* * * * *